US006908189B2

(12) United States Patent
Miyamoto et al.

(10) Patent No.: US 6,908,189 B2
(45) Date of Patent: Jun. 21, 2005

(54) INK JET RECORDING APPARATUS, INK-JET RECORDING METHOD AND INK JET RECORDING MEDIUM

(75) Inventors: Fujio Miyamoto, Hino (JP); Shuji Kida, Iruma (JP); Toyoaki Sugaya, Hachioji (JP); Hidenobu Ohya, Hachioji (JP); Kenichiro Hiramoto, Hachioji (JP); Shinichi Suzuki, Saitama (JP); Teruyuki Fukuda, Hachioji (JP)

(73) Assignee: Konica Corporation, Tokyo (JP)

( * ) Notice: Subject to any disclaimer, the term of this patent is extended or adjusted under 35 U.S.C. 154(b) by 88 days.

(21) Appl. No.: 10/336,279

(22) Filed: Jan. 3, 2003

(65) Prior Publication Data

US 2003/0156176 A1 Aug. 21, 2003

Related U.S. Application Data

(63) Continuation-in-part of application No. 10/255,206, filed on Sep. 26, 2002.

(30) Foreign Application Priority Data

Oct. 5, 2001 (JP) ..... 2001-310276
Jan. 29, 2002 (JP) ..... 2002-019918

(51) Int. Cl.[7] ..... B41J 2/01
(52) U.S. Cl. ..... 347/102; 347/101; 347/105
(58) Field of Search ..... 347/102, 101, 347/105

(56) References Cited

U.S. PATENT DOCUMENTS 4,973,824 A * 11/1990 Ohashi et al. ..... 219/216
5,787,319 A * 7/1998 Tomatsu ..... 399/33
5,787,331 A 7/1998 Ohkuma et al. ..... 399/406
5,867,181 A * 2/1999 Nakane et al. ..... 347/2
6,004,052 A 12/1999 Muranaka ..... 400/636
6,005,594 A * 12/1999 Nanataki et al. ..... 347/156
6,092,891 A 7/2000 Okubo et al. ..... 347/104
6,120,199 A * 9/2000 Takekoshi ..... 400/611
6,243,559 B1 * 6/2001 Kurotaka et al. ..... 399/329
6,250,624 B1 * 6/2001 Kiyohara et al. ..... 271/9.1
6,332,679 B1 * 12/2001 Higuma et al. ..... 347/102
6,406,141 B2 * 6/2002 Yosimura et al. ..... 347/102
2001/0015746 A1 8/2001 Yosimura et al. ..... 347/102
2002/0130939 A1 * 9/2002 Jacob ..... 347/102

FOREIGN PATENT DOCUMENTS

EP 0 373 922 6/1990
EP 373922 A1 * 6/1990 ..... B41F/23/04
JP 61002654 1/1986
JP 02023149 1/1990
JP 07248698 9/1995

* cited by examiner

*Primary Examiner*—Lamson Nguyen
*Assistant Examiner*—Leonard Liang
(74) *Attorney, Agent, or Firm*—Squire, Sanders & Dempsey, L.L.P.

(57) ABSTRACT

A recording method comprising the steps in the following order of: correcting a curl of a recording medium by applying heat and pressure to the recording medium; and forming an image on the recording medium by jetting ink onto the recording medium.

10 Claims, 11 Drawing Sheets

INK JET RECORDING APPARATUS, INK-JET RECORDING METHOD AND INK JET RECORDING MEDIUM

CROSS REFERENCE TO RELATED APPLICATIONS

This is a continuation-in-part application of U.S. patent application Ser. No. 10/255,206, filed on Sep. 26, 2002, of U.S. patent applications by the same applicants/inventors, which title is Ink jet recording apparatus, ink jet recording method and ink jet recording medium, and which is incorporated herein by reference.

FIELD OF THE INVENTION

The present invention relates to an ink jet recording apparatus and an ink jet recording method which accomplish recording by ejecting ink onto a recording medium, and more specifically to an ink jet recording apparatus and an ink jet recording method capable of correcting the curl generating on the recording medium.

Further, the present invention relates to an ink jet recording medium, and specifically to an ink jet recording medium which exhibits improved curl resistant characteristics.

BACKGROUND OF THE INVENTION

Due to recent technical innovations, ink jet recording apparatuses, which accomplish image recording by ejecting minute ink droplets onto a recording surface, have been capable of achieving high image quality approaching conventional silver salt photography, as well as of reducing apparatus cost. As a result, variations of the ink jet recording apparatuses have increasingly been introduced onto the market.

Such ink jet recording apparatuses are constituted in such a manner that image recording is accomplished by ejecting minute ink droplets. As a result, in order to produce higher image quality prints, it is essential that ink droplets be properly ejected onto specified positions. Accordingly, based on such reasons, it has been required that recording be carried out while minimizing the distance between the printing head and the recording medium.

However, the components of recording media, employed in such ink jet recording apparatuses, are mainly comprised of paper materials. As a result, the recording media result in curl, which has occasionally caused problems in which the recording medium comes into contact with the printing head of the ink jet recording apparatus.

As noted above, when, due to the formation of curl, the recording medium comes into contact with the printing head of the ink jet recording apparatus, it becomes impossible to satisfy the essential condition, "to properly eject ink droplets onto the specified positions", resulting in degradation of the image quality of printed images. Further, the contact of the printing head results in abrasion as well as staining on the recording surface of the recording medium, and in the worst case, so-called paper jam occurs in which the recording media are jammed in the interior of the apparatus.

Particularly, when the recording medium is wound into a roll, the magnitude of curl of the recording medium is enhanced due to its roll-set curl. As a result, problems due to contact of the recording medium with the printing head of the ink jet recording apparatus have become more serious.

In order to overcome the contact problems, even though the recording medium is arranged so as to keep it a suitable distance from the printing head of the ink jet recording apparatus, the magnitude of the curl varies depending on properties of the recording medium. Further, when the recording medium is wound into a roll, the magnitude of the curl also varies while unwinding the recording medium. As a result, it has been difficult to arrange the recording medium so as to keep the desired distance from the printing head of the ink jet recording apparatus.

Even after the aforesaid recording media are ejected from the ink jet recording apparatus, problems have occurred in which ejected recording media, when they exhibit curl, are not stacked well on the ejection tray. Still further, problems have occurred in which it is difficult to introduce recording media, which exhibit the tendency of curl, onto the market as a commercially viable product.

On the other hand, in recent years, high image quality, as well as high speed printing, has been demanded for ink jet recording. In order to meet such demands, ink jet recording media are desired which increase ink absorption amount as well as ink absorption rate, and improve glossiness.

Based on the structure of the ink absorptive layer, ink jet recording media are divided mainly into two types. One is an ink jet recording medium comprising a swelling type ink absorptive layer. The medium exhibits desired glossiness, but exhibits a low ink absorption rate. As a result, the resultant image quality is degraded due to color bleeding or beading.

The other type is a porous type ink jet recording medium comprising an ink absorptive layer comprised of a porous layer which is comprised of a small amount of water-soluble binders and crosslinking agents as well as a large amount of inorganic pigments. The medium results in high image quality due to a high ink absorption rate. However, when placed in low humidity ambience, image quality is degraded due to the formation of fine cracks on the surface of the recording medium.

It is possible to form a stable layer by increasing the amount of water-soluble binders or water absorptive resins which are employed in these ink jet recording media. However, when a large amount of the water-soluble resins are employed, the volume of the water-soluble resins varies due to the variation of ambient conditions, and mainly due to the variation of humidity due to swelling and contraction of the resins themselves. As a result, the recording media exhibit curling.

Even though variation due to ambience is minimized by adding fine resinous particles instead of water-soluble binders employed in these ink absorptive layers, irregularity is partially formed immediately after ink absorption when recorded upon employing water based ink.

Specifically, in the case of so-called RC paper which is prepared by coating resins onto both sides of the paper employed as a base material of the recording media, the volume variation due to the base material is relatively small depending on the variation of the ambience. As a result, the difference in the swelling ratio between the ink absorptive layer side and the base material side increases and the tendency to curl increases.

Further, instead of paper sheets, roll paper has increasingly been needed for continuous image production at large runs. Recently, roll recording media have been employed not only for commercial printers (large format printers) but also for personal use printers.

From the viewpoint of the ease of handling as well as decrease in apparatus size, roll recording media, which are wound onto a relatively small diameter core, are demanded. Thus, in the roll recording media, curl is present prior to printing, irrespective of ambient conditions.

When image recording is carried out with a ink jet method onto such a recording medium exhibiting inherent curl, as is described above, during recording, printing quality is degraded due to contact of the recording medium with a printing head as well as variation of the distance between the recording medium and the printing head. Further, after printing, when curl, as well as partial irregularity, remains, image quality is degraded and problems occur when printed media are placed in picture frames or stored in bags. Further, when printed media are adhered onto a wall without any treatment, some part of image may not be visible. When a great magnitude of curl is manually corrected, some part of image may occasionally be damaged.

SUMMARY OF THE INVENTION

From the viewpoint of the foregoing, the present invention has been achieved. An aspect of the present invention is to provide an ink jet recording apparatus and an ink jet recording method which correct curls of the recording medium by applying heat and pressure treatment to the ink jet recording medium. Specifically, an aspect of the present invention is to provide an ink jet recording apparatus and an ink jet recording method which result in the production of high quality image prints by correcting the curl of the recording medium by suitably applying a heating and pressure treatment to the recording medium based on the characteristics, the magnitude of curl and the residual quantity of the roll of the recording medium, and which is capable of producing image prints with minimal curl.

An other aspect of the present invention is to provide an ink jet recording medium in which when prior to printing, the specified tendency of curl is present in the medium and is subjected to a simultaneous heating and pressing treatment, curl may be corrected to the point of being almost flat, and in addition, to provide an image forming method using the same.

Above-described aspects can be achieved by following structures.

PREFERRED EMBODIMENTS OF THE INVENTION

One embodiment of the ink jet recording apparatus according to the present invention will now be described.

Figure 1:
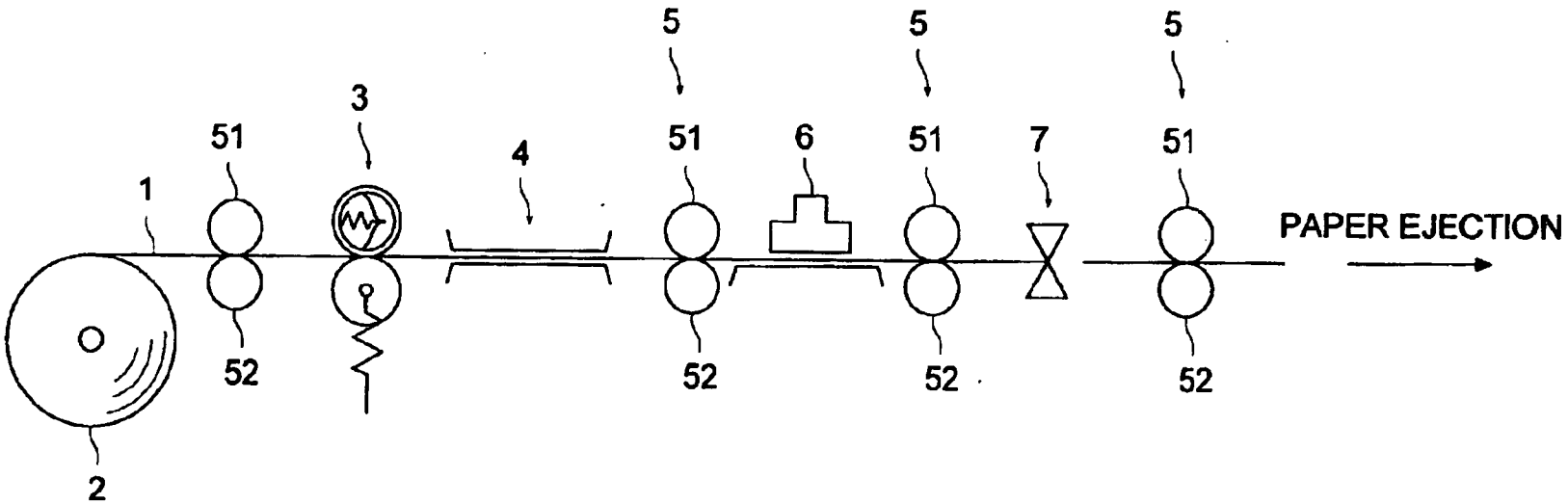
FIG. 1 is a schematic view showing the structure of one embodiment of the ink jet recording apparatus according to claim 1 of the present invention.
Figure 2:
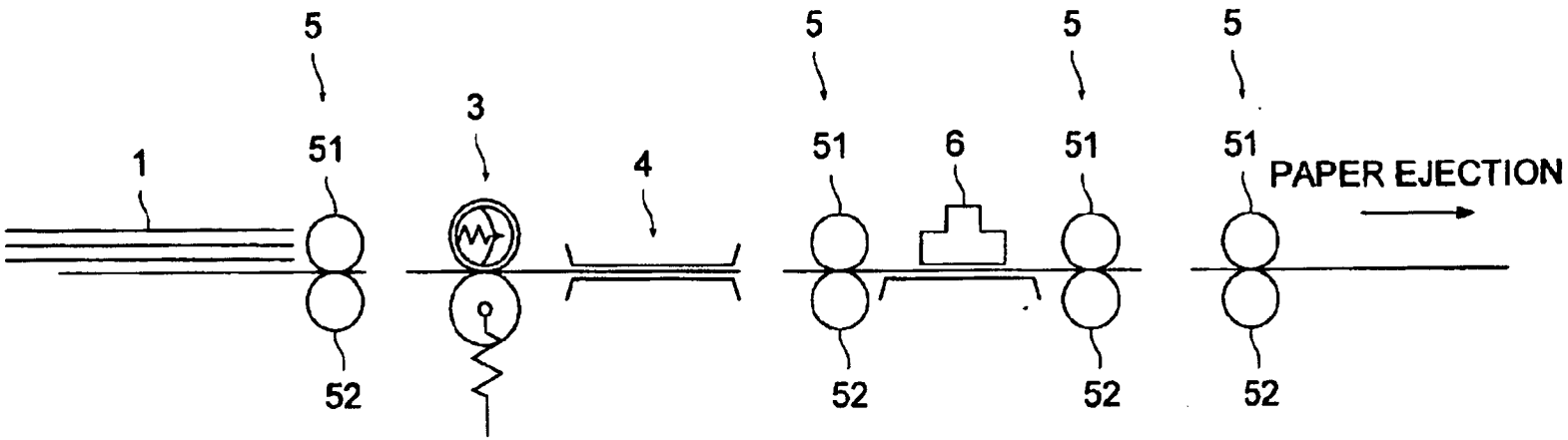
FIG. 2 is a schematic view showing the structure of another example of the ink jet recording apparatus shown in FIG. 1.

FIG. 1 is a schematic view of the structure of an ink jet recording apparatus of the present embodiment. FIG. 2 is a schematic view of the structure showing another example of an ink jet recording apparatus of the present invention.

First Embodiment

FIG. 1 is a schematic view of the structure of the ink jet recording apparatus of the present embodiment. As shown in FIG. 1, the ink jet recording apparatus of the present embodiment is mainly comprised of recording medium bulk roll 2 which has been prepared by winding the recording medium onto a roll, curl correcting section 3 which is a section to correct curl to be flat by applying a heating and pressing treatment to recording medium 1, holding section 4 which holds the curl corrected recording medium 1 to be flat, recording medium transport section which transports recording medium 1, printing head 6 which is a section to record the specified images onto the surface of recording medium 1, and cutting section 7 which is a section to cut the recorded recording medium 1 to the specified size.

Aforesaid recording medium 1 is the recording medium which is wound onto a roll so that the recording surface faces the outside. The recording medium 1 is fed from recording medium bulk roll 2, employing transport roller (driving roller) 51 and driven roller 52 which are arranged in aforesaid recording medium transport section 5 and is transported toward the right in FIG. 1.

Incidentally, the position for arranging aforesaid transport roller (driving roller) 51 and aforesaid driven roller 52 and the number of arranged rollers are not limited to those shown in FIG. 1.

Further, employed as aforesaid recording medium 1 may be recording sheets which have been cut to the specified size. When such sheets are employed, the ink jet recording apparatus is to be structured as shown in FIG. 2, namely structured so that aforesaid cutting section 7 is eliminated.

Figure 3:
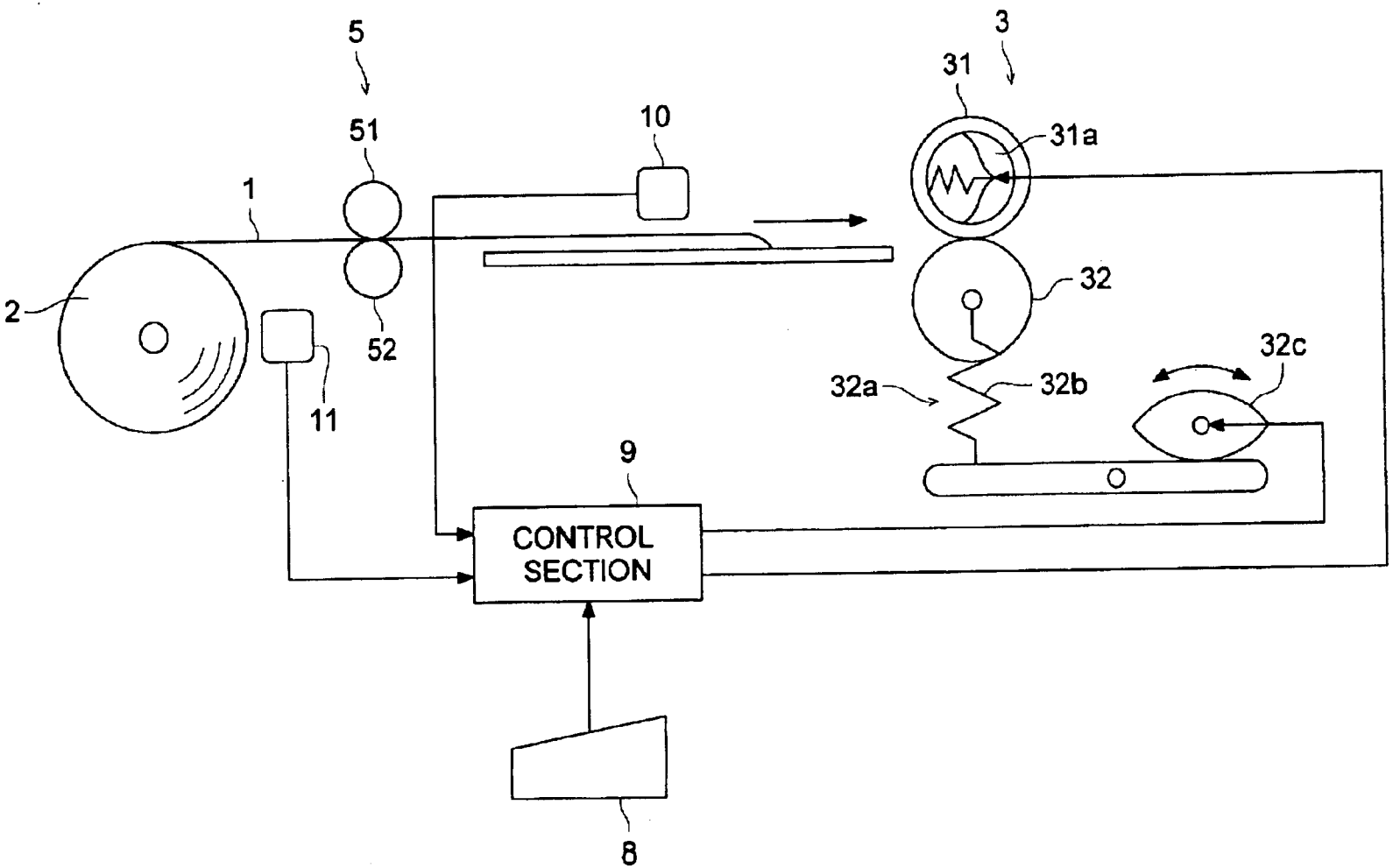
FIG. 3 is a view showing the control constitution of the curl correcting section of the ink jet recording apparatus shown in FIG. 1.

FIG. 3 is a partially enlarged view of aforesaid curl correcting section 3 (refer also to FIG. 1). As shown in FIG. 3, the aforesaid curl correcting section 3 is comprised mainly of heating roller 31 having a heating device and pressing roller 32 having a pressing device, which is arranged to face the heating roller 31. Aforesaid heating roller 31 is comprised of a hollow metal roller, and has heating element 31*a* such as a halogen heater as a heating source in its interior parallel to its shaft direction. The heating roller 31 is heated utilizing heat generated by the heating element 31*a*. Subsequently, recording medium 1 is pressed by the heating roller 31 so that its curl is thermally corrected. Further, aforesaid pressing roller 32 is comprised of a rubber roller and comprises pressing device 32*a* fitted with springs which presses the pressing roller 32 against the heating roller 31. Further, the pressing roller 32 is pressed onto heating roller 31, employing pressing force of the pressure section 32*a* and recording medium 1 is introduced between the rollers so that its curl is corrected due to pressure.

Further, aforesaid control section 9 is structured as described below. Aforesaid heating roller 31 and aforesaid pressing roller 32 are connected to control section 9 which is a section to control heating temperature employing aforesaid heating roller 31 and applying pressure employing aforesaid pressing roller 32 based on input data from input section 8, which is a section to input the thickness and the type of aforesaid recording medium 1. Accordingly, by inputting the thickness and the type of the recording medium to aforesaid input section 8, the control section 9 appropriately controls heating temperature employing aforesaid heating roller 31 and applying pressure employing aforesaid pressing roller 32 based on the thickness and the type of aforesaid recording medium 1.

Still further, aforesaid control section is also structured as described below. Aforesaid heating roller 31 and aforesaid pressing roller 32 are connected to control section 9 which is a section to appropriately control heating temperature employing aforesaid heating roller 31 and applying pressure employing aforesaid pressing roller 32 based on results detected by curl sensor 10 such as an adjacent sensor which is a section to detect the magnitude of curl of aforesaid recording medium 1 and residual roll quantity sensor 11 such as an adjacent sensor which is a section to detect residual quantity of aforesaid recording medium bulk roll 2. Accordingly, the control section 9 appropriately controls heating temperature employing aforesaid heating roller 31 and applying pressure employing aforesaid pressing roller 32 based on the magnitude of the curl of recording media and the residual quantity of recording medium bulk roll 2 which are obtained from the results detected by aforesaid curl sensor 10 and aforesaid residual roll quantity sensor 11.

Incidentally, heating temperature is controlled by aforesaid heating roller 31 in such a manner that the control section 9 controls electric power applied to heating element 31*a* in the interior of the heating roller 31. By so doing, the surface temperature of the heating roller 31 is maintained in the desired range, whereby the curl of the recording medium 1 is optimally corrected. Specifically, the temperature range to optimally correct the curl of recording media is preferably in the range of 60 to 130° C., and more preferably 80 to 100° C.

Pressure applied by aforesaid pressing roller 32 is controlled in such a manner that pressure applied to the pressing roller 32 of aforesaid pressure section 32*a* is controlled. For example, aforesaid pressure section 32*a* is comprised of spring 32*b* and eccentric cam 32*c*. By controlling the rotation position of the driving motor (not shown in FIG. 3), pressing force, which is applied to aforesaid pressing roller 32 by the spring 32, is controlled. By so doing, the pressing force of aforesaid pressing roller 32 applied to recording medium 1 is optimally controlled, whereby the curl of the recording medium 1 can be optimally corrected.

Figure 4:
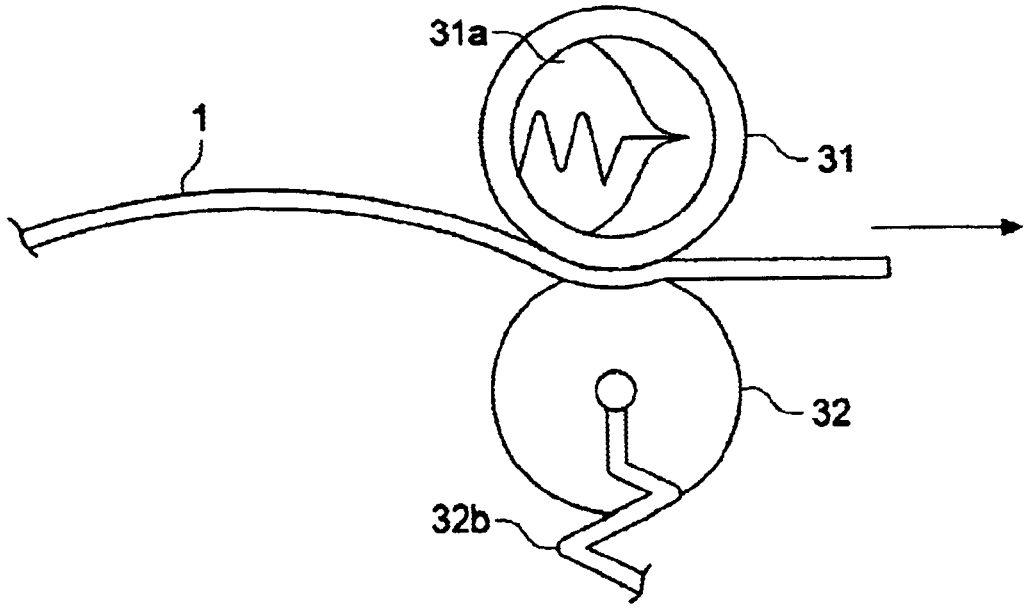
FIG. 4 is an enlarged view of a portion of the curl correcting section of the ink jet recording apparatus shown in FIG. 1.

FIG. 4 is a partially enlarged view about aforesaid heating roller 31 and the pressing roller 32. As mentioned above, aforesaid heating roller 31 is a metal roller, and aforesaid pressing roller 32 is a rubber roller. FIG. 4 is an exaggerated view showing recording material 1 which is transported while interposed between the rollers. Namely, the convex curve of the curl of the recording medium 1 is positioned so as to face the heating roller 31 comprised of a metal roller, and the recording medium is passed between the rollers. As a result, the curl of the recording medium 1 is corrected in the opposite direction, whereby it is corrected to be flat. By so doing, heating and pressing result in additional desired effects, and thereby the curl of the recording medium 1 is corrected to be flatter.

Incidentally, difference in hardness between aforesaid heating roller 31 and aforesaid pressing roller 32 is preferably at least a factor of 2. Practical results, which support the foregoing, are shown below:

Evaluations were done by utilizing following classification.

A: The curl was completely corrected.

B: The curl was approximately corrected while a little curl still remained.

C: The curl remained while practically applicable.

Practical Result 1: no difference in hardness between rollers resulted in C rank for the correction degree of curl of the recording medium.

Practical Result 2: a difference factor of 1.3 in hardness between rollers resulted in C rank for the correction degree of curl of the recording medium.

Practical Result 3: a difference factor 1.5 in hardness between rollers resulted in C rank for the correction degree of curl of the recording medium.

Practical Result 4: a difference factor 1.8 in hardness between rollers resulted in B rank for the correction degree of curl of the recording medium.

Practical Result 5: a difference factor 2.0 in hardness between rollers resulted in A rank for the correction degree of curl of the recording medium.

As mentioned above, it was confirmed that when difference in hardness between aforesaid heating roller 31 and aforesaid pressing roller 32 was at least a factor of 2, the curl of recording medium 1 was optimally corrected. Thus, it was concluded that difference in hardness between aforesaid heating roller 31 and aforesaid pressing roller 32 was preferably at least a factor of 2.

As a result, it was decided that employed as rubber materials constituting aforesaid pressing roller 32 were those having at most one half the hardness of the metal constitution aforesaid heating roller 31, as determined employing the hardness measurement method specified in JIS K 6253 (corresponding to ISO 48-1994 and ISO 7619-1997), of metals constituting the heating roller 31.

Figure 5:
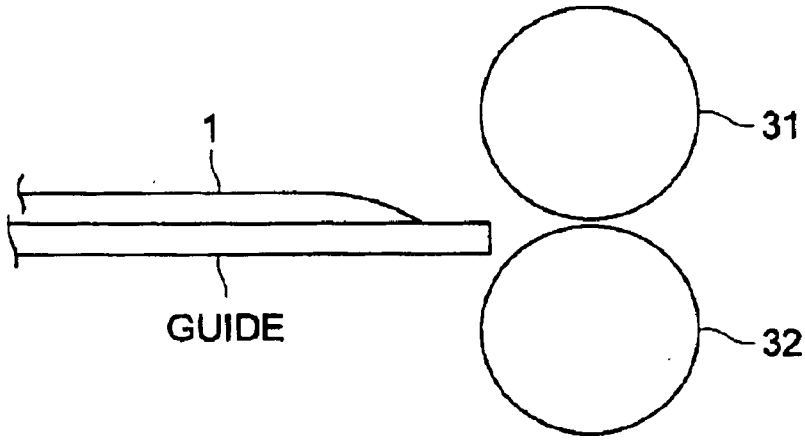
FIG. 5 is a view for explaining the feeding of recording medium into the curl correcting section.
Figure 5:
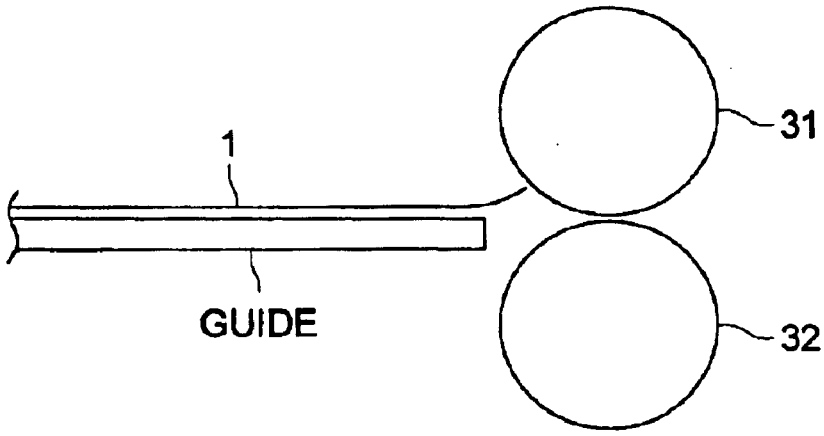

Further, since the curl correcting section 3 comprises a pair of aforesaid heating roller 31 and aforesaid pressing roller 32, it is preferable that aforesaid recording medium 1 is transported so that the convex-shaped surface of the curl is positioned as the upper surface. As shown in FIG. 5(*a*), when the recording medium 1 is transported in such a manner that the convex-shaped surface of the curl is positioned as the upper surface, the recording medium 1 is relatively smoothly introduced into the curl correcting section 3. On the other hand, as shown in FIG. 5(*b*), when transport medium 1 is transported in such a manner that the convex-shaped surface is positioned as the lower surface, it is problematic to smoothly introduce the recording medium 1 into the curl correcting section 3 due to the fact that the leading edge striles the curl correcting section 3. As mentioned above, when the smooth introduction of recording medium 1 into the curl correcting section 3 is hindered, abrasion as well as wrinkles was occasionally formed. Therefore, it is decided that aforesaid recording medium 1 be transported in such a manner that the convex side of the curl be position as the upper surface.

Aforesaid holding section 4 belongs to aforesaid curl correcting section 3, which is arranged downstream in the recording medium transport direction of aforesaid curl correcting section 3. Recording medium 1, which has been subjected to a heating and pressing treatment, employing aforesaid curl correcting section 3, is required to remain flat until it is sufficiently cooled so that the resultant flatness is retained. It has been decided that flatness is retained by arranging the holding section 4. The holding section 4 is formed to be flat utilizing metal plates which interpose recording medium 1 from the upper and lower directions so as to correct the recording medium 1 to be flat.

By arranging curl correcting section 3 as well as holding section 4, described as above, upstream in the recording medium transport direction of aforesaid printing head 6, the curl of recording medium 1 is corrected before recording is carried out employing aforesaid printing head 6. By so doing, desired quality of recording is carried out employing aforesaid printing head.

However, for the purpose of minimizing the curl of the recording medium after ejection, the curl correcting section 3 as well as the holding section 4 is occasionally arranged at the position just prior to medium ejection, namely in the position downstream in the recording medium transport direction of aforesaid cutting section 7. In practice, the curl of the recording medium after ejection also causes big problems. Therefore, it is considered that the embodiment is also preferably utilized.

Figure 6:
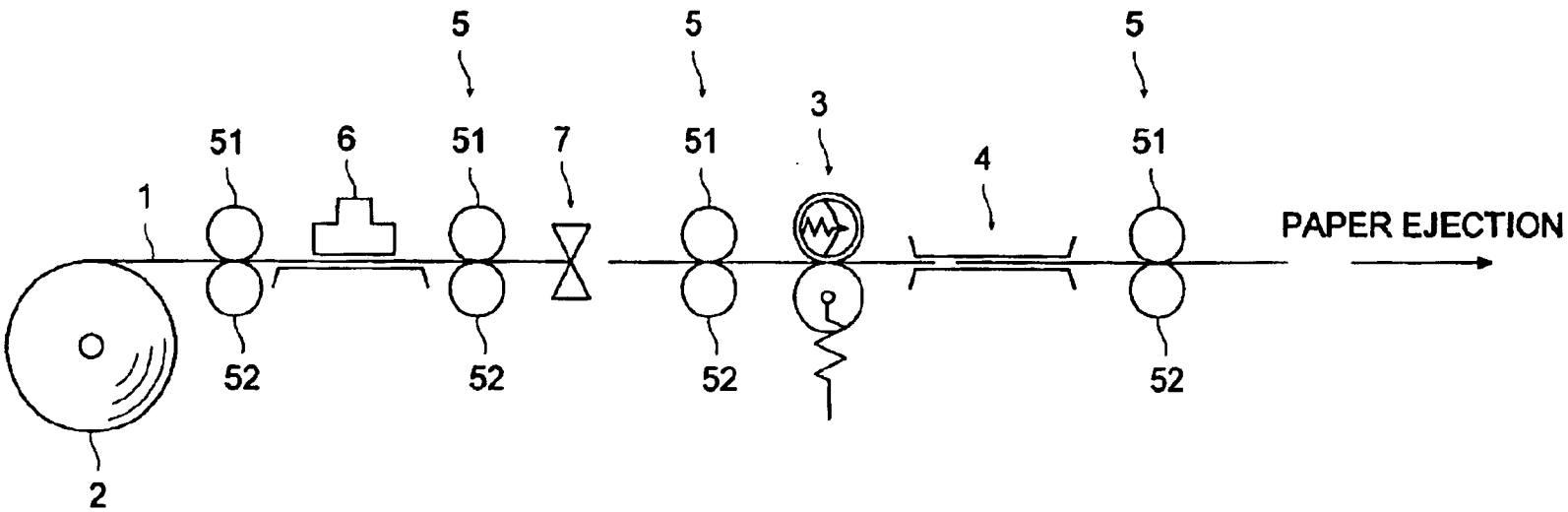
FIG. 6 is a schematic view showing the structure of another example of the ink jet recording apparatus shown in FIG. 1.

In such cases, the ink jet recording apparatus is structured as shown in FIG. 6. Namely, the ink jet recording apparatus is structured in such a manner that the curl correcting section 3 as well as the holding section 7 is arranged downstream in the recording medium transport direction of aforesaid cutting section 7.

Herein, FIG. 1 will now be further detailed. Aforesaid recording medium transport section 5 is comprised of transport roller 51 which is rotated by a driving motor (not shown) and driven roller 52 which is arranged to face the transport roller 51. The ink jet recording apparatus is structured in such a manner that recording medium 1 is interposed between the transport roller 51 and the driven roller 52, and the specified length of the recording medium 1 is transported toward the right in FIG. 1, employing the rotation of the transport roller 51, in accordance with image recording employing printing head 6, described below, and cutting employing cutting section 7, also described below.

Aforesaid printing head 6 is a back-and-forth scanning type printing head which is structured in such a manner that the primary scanning is movable along a scanning guide (not shown) which is provided so as to be approximately orthogonal to the transport direction of the recording medium 1 along its width direction. The printing head 6 comprises a plurality of ink tanks which store each color ink such as Y (yellow), M (magenta), C (cyan), and K (black), and ejects the specified ink at specified timing based on image data while moving for primary scanning along the scanning guide so that the specified images are formed on the recording surface of the recording medium 1 through the cooperation of the transport of recording medium 1 by aforesaid transport means 5.

Aforesaid cutting section 7 is, for example, a back-and-forth scanning type circular cutter which is constituted so that primary scanning is movable along the scanning guide (not shown) which is arranged so as to be approximately orthogonal in the transport direction of the recording medium 1 along its width direction. The cutting section 7 cuts recording medium 1 into the specified size employing a control means (not shown). Incidentally, the arrangement position of the cutting section 7 is not limited to the foregoing. For example, the cutting section 7 may also be arranged upstream in the recording medium transport direction of aforesaid curl correcting section 3.

Recording medium 1, which has been cut to the specified size, is ejected to the exterior of the ink jet recording apparatus, namely onto a tray to hold ejected paper sheets.

Second Embodiment

An ink jet recording apparatus will now be described which carries out a fixing process to a recording medium.

Figure 7:
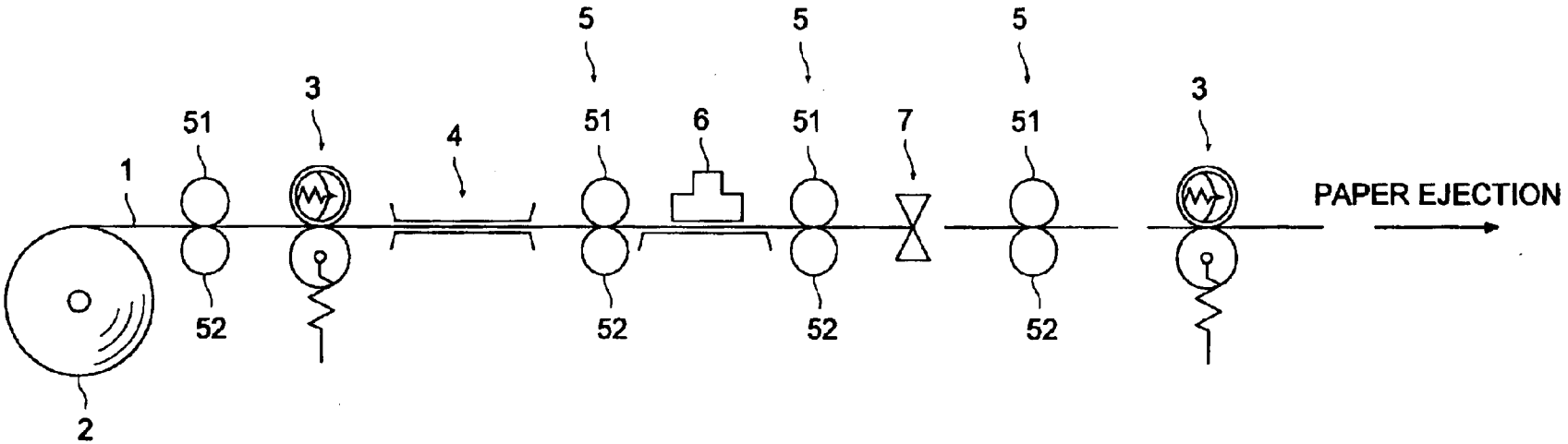
FIG. 7 is a schematic view of the structure showing one embodiment of the ink jet recording apparatus according to claim 2 of the present invention.

FIG. 7 is a schematic view showing the structure of the ink jet recording apparatus of the present embodiment. As shown in FIG. 7, an ink jet recording apparatus of the present embodiment is mainly comprised of recoding medium bulk roll 2 which has been prepared by winding recording medium into a roll, curl correcting section 3 which is a section to correct curl to be flat through applying a heating and pressing treatment to recording medium 1, holding section 4 which a section to hold the curl corrected recording medium 1 to be flat, recording medium transport section 5 which is a section to transport recording medium 1, printing head 6 which is a section to record the specified images onto the recording surface of recording medium 1, cutting section 7 which is a section to cut recorded recording medium to the specified size, and fixing section 12 which is a section to carry out fixing treatment of the ink absorptive layer as a surface layer of the recording medium upon applying heating pressing treatment to the recording medium.

Aforesaid recording medium 1 is a so-called recording medium comprising an ink absorptive layer as a surface layer and further a recording medium which is wound onto a roll so that the recording surface comprising the ink absorptive layer is on the outside. Listed as preferably employed recording media are the recording media which are specified in JIS B 0601 (corresponding to ISO 468-1982, ISO 3274-1975, ISO 4287/1-1984, ISO 4287/2-1984 and ISO 4288-1985), and those which satisfy the condition of the center line mean roughness of 0.8 to 4.0 when the ink absorptive layer is measured at a standard length of 2.5 mm and a cut-off value of 0.8 mm. By employing such recording media, it is possible to preferably correct the curl of the recording medium. The recording medium 1 is fed from the recording medium bulk roll 2 employing transport roller (driving roller) 51 and driven roller 52, and is transported in the right direction in FIG. 7.

Incidentally, the arrangement position of aforesaid transport roller (driving roller) 51 and aforesaid driven roller 52 as well as the number of those rollers is not limited to those shown in FIG. 7.

Figure 8:
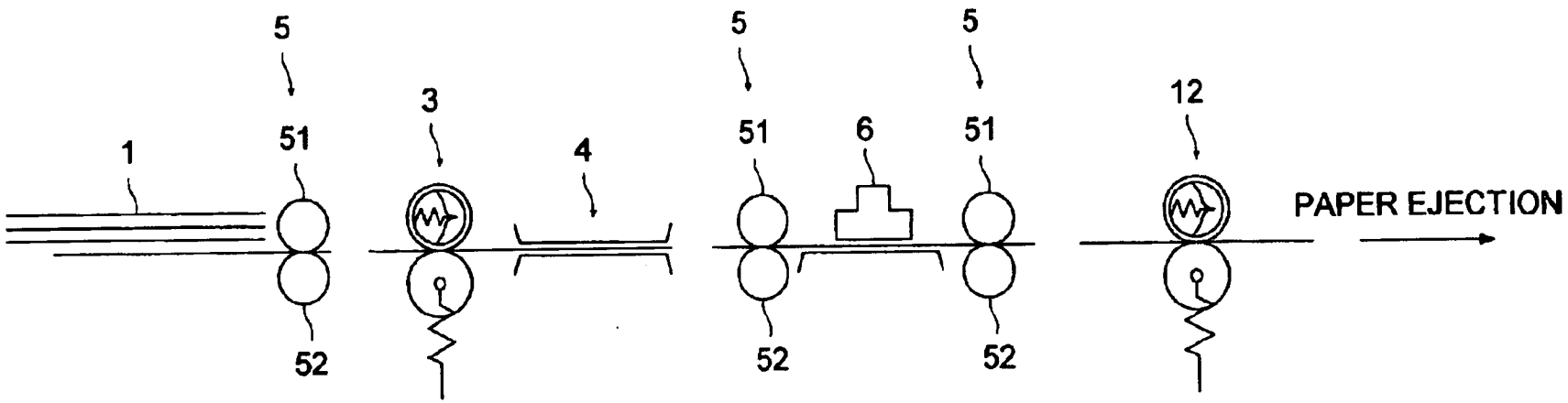
FIG. 8 is a schematic view of the structure of another example of the ink jet recording apparatus shown in FIG. 7.

Further, as aforesaid recording medium 1, it is possible to use sheet recording medium which has been cut into the specified size. When the sheet recording medium is employed, the ink jet recording apparatus is to be structured as shown in FIG. 8 in which aforesaid cutting section 7 is eliminated.

Upon referring to FIG. 3, a partially enlarged view about aforesaid curl correcting section 3 (refer to FIG. 7) is shown. As shown in the drawing, aforesaid curl correcting section 3 is mainly comprised of heating roller 31 having a heating device and pressing roller 32 having a pressing device, which is arranged to face the heating roller 31. The heating roller 31 is comprised of a hollow metal roller, and has heating element 31*a* such as a halogen heater as a heating source in its interior along its shaft direction. The heating roller 31 is heated utilizing heat generated by the heating element 31*a*. Subsequently, recording medium 1 is pressed by the heating roller 31 so that its curl is thermally corrected. Further, the pressing roller 32 is comprised of a rubber roller and comprises pressure section 32*a* fitted with springs which presses the pressing roller 32 against the heating roller 31. Further, the pressing roller 32 is pressed onto heating roller 31, employing pressing force of the pressure section 32*a* and recording medium 1 is introduced between the rollers so that its curl is corrected due to pressure.

Further, aforesaid curl correcting section 3 is structured as described below. Aforesaid heating roller 31 and aforesaid pressing roller 32 are connected to control section 9 which is a means to control heating temperature employing aforesaid heating roller 31 and applying pressure employing aforesaid pressing roller 32 based on input data from input section 8 which is a means to input the thickness and the type of aforesaid recording medium 1. When an operator inputs the thickness and the type of aforesaid recording medium 1 into input section 8, the control section 9 appropriately controls heating temperature employing the heating roller 31 and applying pressure employing the pressing roller 32 based on the thickness and the type of aforesaid recording medium 1.

Still further, aforesaid heating roller 31 and aforesaid pressing roller 32 are connected to control section 9 which is a section to appropriately control heating temperature employing aforesaid heating roller 31 and applying pressure employing aforesaid pressing roller 32 based on detection results from curl sensor 10 which is a section to detect the magnitude of curl of aforesaid recording medium 1 and the residual roll quantity sensor 11 which is a section to detect the residual roll quantity of aforesaid recording medium bulk roll 2. Accordingly, the control section 9 appropriately controls heating temperature employing aforesaid heating roller 31, and applying pressure employing aforesaid pressing roller 32 based on the magnitude of the curl of aforesaid recording medium 1 and the residual roll quantity of aforesaid recording medium bulk roll 2.

Incidentally, heating temperature is controlled by aforesaid heating roller 31 in such a manner that aforesaid control section 9 controls electric power applied to heating element 31*a* in the interior of the heating roller 31. By so doing, the surface temperature of aforesaid heating roller 31 is maintained in the desired range, whereby the curl of recording medium 1 is optimally corrected. Specifically, the temperature range to optimally correct the curl of recording media is preferably from 60 to 130° C., and more preferably from 80 to 100° C.

Further, pressure applied by aforesaid pressing roller 32 is controlled in such a manner that pressure applied to the pressing roller 32 of aforesaid pressure section 32*a* is controlled. For example, aforesaid pressure section 32*a* is comprised of spring 32*b* and eccentric cam 32*c*. By controlling the rotation position of the driving motor (not shown), pressing force, which is applied to aforesaid pressing roller 32 by aforesaid spring 32, is controlled. By so doing, the pressing force of aforesaid pressing roller 32 applied to recording medium 1 is optimally controlled, whereby the curl of the recording medium 1 can be optimally corrected.

Referring to FIG. 4, a partially enlarged view of aforesaid heating roller 31 and aforesaid pressing roller 32 is shown. As mentioned above, aforesaid heating roller 31 is a metal roller, and aforesaid pressing roller 32 is a rubber roller. FIG. 4 is an exaggerated view showing aforesaid recording material 1 which is transported while interposed between the rollers. Namely, the convex of the curl of the recording medium is positioned so as to face heating roller 31 comprised of aforesaid metal roller, and the recording medium is passed between the rollers. As a result, the curl of the recording medium 1 is corrected in the opposite direction, whereby it is corrected to be flat. By so doing, heating and pressing result in additional desired effects, and thereby the curl of the recording medium is corrected to be flatter.

Incidentally, difference in hardness between aforesaid heating roller 31 and aforesaid pressing roller 32 is preferably at least a factor of 2. Practical results, which support the foregoing, are described above.

As mentioned above, it was confirmed that when difference in hardness between aforesaid heating roller 31 and aforesaid pressing roller 32 was at least a factor of 2, the curl of recording medium 1 was optimally corrected. Thus, it was concluded that difference in hardness between aforesaid heating roller 31 and aforesaid pressing roller 32 was preferably at least a factor of 2.

As a result, it was preferable that employed as rubber materials constituting aforesaid pressing roller 32 were those having at most one half the hardness, which was determined employing the hardness measurement method specified in JIS K 6253, of metals constituting aforesaid heating roller 31.

Further, since the curl correcting section 3 comprises a pair of aforesaid heating roller 31 and aforesaid pressing roller 32, it is preferable that aforesaid recording medium 1 is transported so that the convex-shaped surface of the curl is positioned as the upper surface. As shown in FIG. 5(*a*), when recording medium 1 is transported in such a manner that the convex-shaped surface of the curl is positioned as the upper surface, the recording medium 1 is relatively smoothly introduced into the curl correcting section 3. On the other hand, as shown in FIG. 5(*b*), when transport medium 1 is transported in such a manner that the convex-shaped surface is positioned as the lower surface, it is impossible to smoothly introduce recording medium 1 into the curl correcting section 3 due to the fact that the leading edge strikes the curl correcting section 3. As mentioned above, when the smooth introduction of recording medium 1 into the curl correcting section 3 is hindered, abrasion as well as wrinkles was occasionally formed. Therefore, it is decided that aforesaid recording medium 1 is transported in such a manner that the convex-shaped surface of the curl is position as the upper surface.

Aforesaid holding section 4 belongs to aforesaid curl correcting section 3 which is arranged downstream in the recording medium transport direction of aforesaid curl correcting section 3. Recording medium 1, which has been subjected to a heating and pressing treatment, employing aforesaid curl correcting section 3, is required to remain flat until it is sufficiently cooled so that the resultant flatness is retained. It has been decided that flatness is maintained by arranging the holding section 4. The holding section 4 is formed to be flat utilizing metal plates which interpose recording medium 1 from the upper and lower directions so as to correct the recording medium 1 to be flat.

By arranging curl correcting section 3 as well as holding section 4, described as above, upstream in the recording medium transport direction of aforesaid printing head 6, the curl of recording medium 1 is corrected before recording is carried out employing aforesaid printing head 6. By so doing, preferable recording is carried out employing aforesaid printing head.

However, for the purpose of minimizing the curl of the recording medium after ejection, the curl correcting section 3 as well as the holding section 4 is occasionally arranged at the position just prior to medium ejection, namely in the position downstream in the recording medium transport direction of aforesaid cutting section 7. In practice, the curl of the recording medium after ejection also causes big problems. Therefore, it is considered that the embodiment is also preferably utilized.

Herein, FIG. 7 will now be further detailed. Aforesaid recording medium transport section 5 is comprised of transport roller 51 which is rotated employing a driving motor (not shown) and driven roller 52 which is arranged to face the transport roller 51. The ink jet recording apparatus is structured in such a manner that recording medium 1 is interposed between transport roller 21 and driven roller 22, and the specified length of the recording medium 1 is transported toward the right in FIG. 7, employing the rotation of aforesaid transport roller 21, in accordance with image recording employing printing head 6, described below, and cutting employing cutting section 7, also described below.

Aforesaid printing head 6 is a back-and-forth scanning type printing head which is structured in such a manner that the primary scanning is movable along a scanning guide (not shown) which is provided so as to be approximately orthogonal to the transport direction of the recording medium 1 along its width direction. The printing head 6 comprises a plurality of ink tanks which store each color ink such as Y (yellow), M (magenta), C (cyan), and K (black), and ejects the specified ink at specified timing based on image data while moving for primary scanning along the scanning guide so that the specified images are formed on the recording surface of the recording medium 1 through the cooperation of the transport of recording medium 1 by aforesaid transport means 5.

Aforesaid cutting section 7 is, for example, a back-and-forth scanning type circular cutter which is constituted so that primary scanning is movable along the scanning guide (not shown) which is arranged so as to be approximately orthogonal in the transport direction of the recording medium 1 along its width direction. The cutting section 7 cuts recording medium 1 into the specified size employing a control means (not shown). Incidentally, the arrangement position of the cutting section 7 is not limited to the foregoing. For example, the cutting section 7 may also be arranged upstream in the recording medium transport direction of aforesaid curl correcting section 3.

Recording medium 1, which has been cut to the specified size at the cutting section 7, is then transported to fixing section 12.

Figure 9:
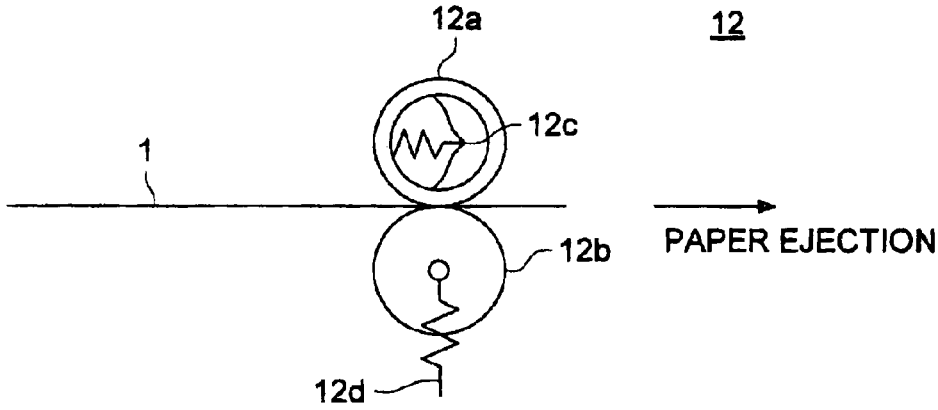
FIG. 9 is a schematic view of the structure of one embodiment of the fixing section of the ink jet recording apparatus shown in FIG. 7.

FIG. 9 is a view showing one embodiment of aforesaid fixing section 12. The fixing section 12 is arranged downstream in the recording medium transport direction of aforesaid printing head 6 so that after recording images employing aforesaid printing head 6, the resultant recording medium is subjected to a fixing treatment (a heating pressing treatment). Incidentally, it is possible to employ fixing apparatuses utilizing various fixing systems, known in the art, such as a roller fixing system and a belt fixing system. Therefore, in the present embodiment, employed is the roller fixing method, which is thus only briefly explained below.

As shown in FIG. 9, the fixing section is mainly comprised of heating roller 12*a*, having a heating device, and pressing roller 12*b* which has a pressing device arranged to face the heating roller 12*a*. Heating roller 12*a* is comprised of a hollow metal roller and comprises heating element 12*c* such as a halogen heater as a heating source in its interior along its shaft direction. The heating roller 12*a* is heated utilizing heat generated by the heating element 12*c*. Subsequently, recording medium 1 is pressed with the heating roller 31 so that the ink absorptive layer of the recording medium 1 is thermally fused. Further, pressing roller 12*b* is comprised of a rubber roller, fitted with pressure section 12*d* comprised of springs, which presses the pressing roller 12*b* against heating roller 12*a*. Heating roller 12*a* is pressed by the pressing roller 12*b*, utilizing pressing force of pressure section 12*d*, whereby the ink absorptive layer of recording medium 1, which is interposed between the rollers, is flattened.

Recording medium 1 of which ink absorptive layer has been subjected to a fixing treatment, employing the fixing section 12, is sufficiently cooled and then ejected to the exterior of the ink jet recording apparatus, namely to a tray holding ejected paper sheets.

Other examples of aforesaid curl correcting section 3 in (First Embodiment) and (Second Embodiment) will now be described.

Another Example 1

Figure 10:
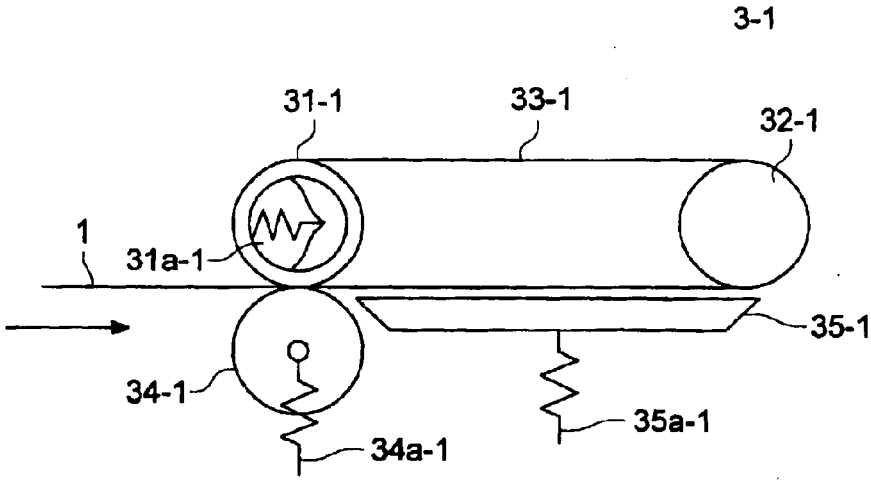
FIG. 10 is a schematic view of the structure showing another example of the curl correcting section of the ink jet recording apparatus according to the present invention.

FIG. 10 is a view showing another example of aforesaid curl correcting section 3. As shown in FIG. 10, curl correcting section 3-1 in the present example is mainly comprised of heating roller 31-1 which has a heating device, driven roller 32-1 which is driven by the heating roller 31-1, heating belt 33-1 which is suspended between the rollers, pressing roller 34-1 having a pressing device which is arranged to face the heating roller 31-1, and pressing plate 35-1 having a pressing device which is arranged to face the heating belt 33-1. The heating roller 31-1 is comprised of a hollow metal roller, and has in its interior heating element 31*a*-1, such as a halogen heater as a heat generating source parallel to its shaft. Further, the heating roller 31-1 and in addition, aforesaid heating belt 33-1 are heated utilizing heat generated by the heating element 31*a*-1. The curl of recording medium 1, which is pressed with those is thermally corrected. Further, pressing roller 34-1 is comprised of a rubber roller, which is fitted with pressure section 34*a*-1 comprised of springs which press the pressing roller 34-1 against heating roller 31-1. Further, aforesaid heating roller 31-1 is pressed by the pressing roller 34-1 utilizing pressing force of the pressure section 34*a*-1. The recording medium 1 is transported between these rollers so that its curl is corrected by pressure. Incidentally, the pressure section 35*a*-1 may be abbreviated upon fixing the pressure plate 35-1 at the suitable position.

As mentioned above, by comprising the curl correcting section employing the belt system, it is possible to carry out heating and pressing treatment for a sufficient time to correct the curl of the recording medium. As a result, it is possible to correct the curl, to result in flatter the recording medium.

Another Example 2

Figure 11:
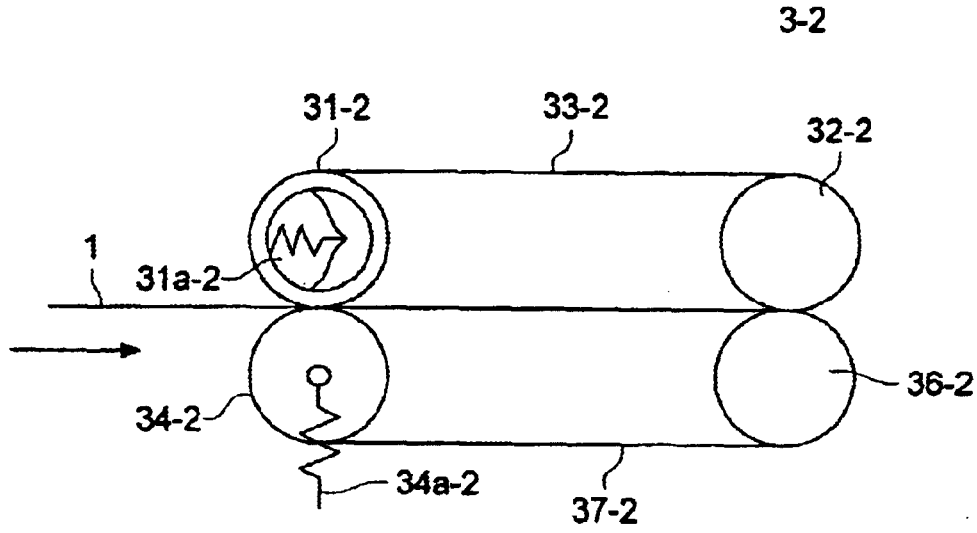
FIG. 11 is a schematic view of the structure showing another example of the curl correcting section shown in FIG. 10.

FIG. 11 is a view of an additional other example of aforesaid curl correcting section 3. As shown in FIG. 11, curl correcting section 3-2 in the present example is mainly comprised of heating roller 31-2 having a heating device, driven roller 32-2 which is driven by the heating roller 31-2, heating belt 33-2 suspended between the rollers, pressing roller 34-2 having a pressing device which is arranged to face aforesaid heating roller 31-2, driven roller 36-2 which is driven by the pressing roller 34-2, and pressing belt 37-2 suspended between the rollers. Heating roller 31-2 is comprised of a hollow metal roller and has heating element 31*a*-2 such as a halogen heater as a heat generating source in its interior parallel to its shaft. Further, the heating roller 31-2 and in addition, aforesaid heating belt 33-2 are heated utilizing heat generated by the heating element 31*a*-2. Recording medium 1 is pressed by this system, whereby its curl is thermally corrected. Further, pressing roller 34-2 comprises pressure section 34*a*-2 comprised of springs which press the pressing roller 34-2 agent heating roller 31-2. The heating roller 31-2 is pressed by the pressing roller 34-2 utilizing pressing force of the pressure section 34*a*-2. Recording medium 1 is fed between these rollers whereby it curl is correct red by pressure. Further, pressing belt 37-2 presses recording medium 1 against aforesaid heating belt 33-2 employing its tension or a pressing device (not shown), whereby the curl of recording medium transposed between these is corrected by pressure.

As mentioned above, by comprising the curl correcting section employing the belt system, it is possible to carry out heating and pressing treatment for a sufficient time to correct the curl of the recording medium. As a result, it is possible to correct the curl, to result in flatter the recording medium.

Another Example 3

Figure 12:
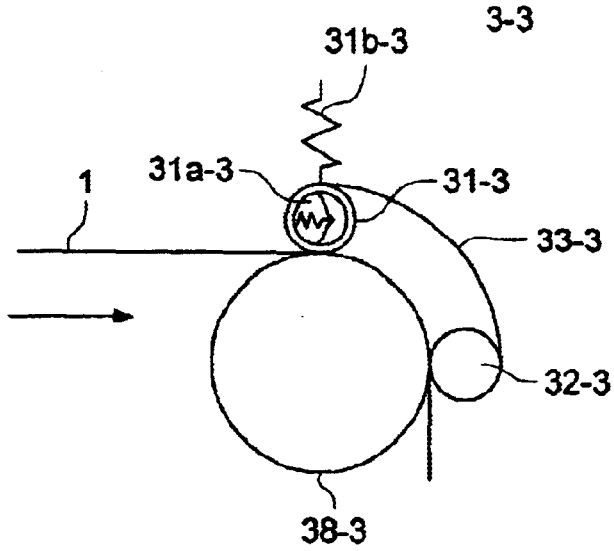
FIG. 12 is a schematic view of the structure showing still another example of the curl correcting section of the ink jet recording apparatus according to the present invention.

FIG. 12 is a view of an additional other example of aforesaid curl correcting section 3. As shown in FIG. 12, curl correcting section 3—3 in the present example is mainly comprised of heating and pressing roller 31-3 having a heating device as well as a pressing device, driven roller 32-3 which is driven by the heating and pressing roller 31-3, heating belt 33-3 suspended between the rollers, and drum roller 38-3 which is arranged to face the heating belt 33-3. Heating and pressing roller 31-3 is comprised of a hollow metal roller and has heating element 31*a*-3 such as a halogen heater as a heat generating source in its interior parallel to its shaft. Further, the heating and pressing roller 31-3 and in addition, aforesaid heating belt 33-3 are heated utilizing heat generated by the heating element 31*a*-3. Recording medium 1 is pressed by this system, whereby its curl is thermally corrected. Further, aforesaid heating and pressing roller 31-3 comprises pressing device 31*b*-3 comprised of springs which press the heating and pressing roller 31-3 against drum roller 38-3. Aforesaid drum roller 38-3 is pressed by the heating and pressing roller 31-3, utilizing pressing force of the pressure section 31*b*-3. Recording medium 1 is fed between these rollers whereby its curl is corrected by pressure. Further, pressing belt 33-3 presses recording medium 1 against aforesaid heating belt 38-3 employing its tension or a pressure application means (not shown), whereby the curl of recording medium transposed between these is corrected by pressure.

As mentioned above, the curl correcting section is comprised of a belt and a drum roller and is structured to correct the curl of recording media, utilizing the curvature of the drum roller. Then, it is possible to simplify the curl correcting section 3, and in addition, to carry out a heating and pressing treatment over a sufficient period of time to correct the curl of the recording media. As a result, it is possible to cut production cost as well as to correct the curl for a flatter recording medium.

Another Example 4

Figure 13:
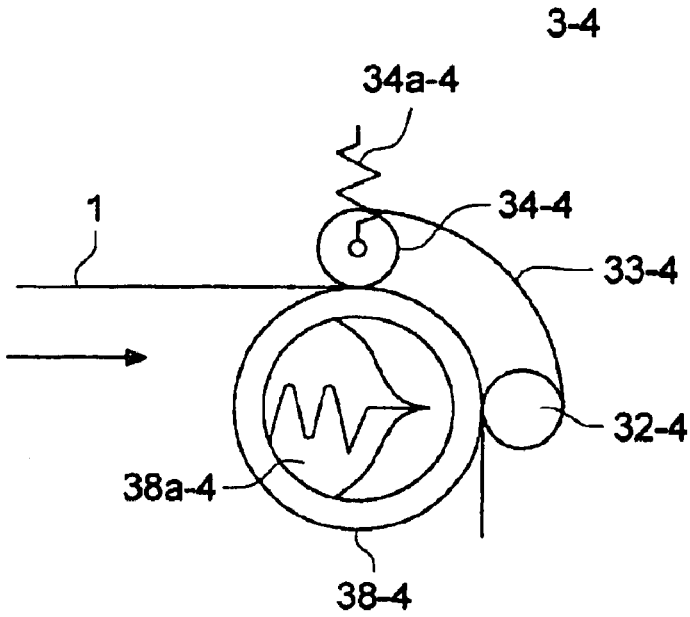
FIG. 13 is a schematic view of the structure showing another example of the correcting section shown in FIG. 12.

FIG. 13 is a view showing further another example of aforesaid curl correcting section 3. As shown in FIG. 13, curl correcting section 3-4 is comprised mainly of pressing roller 34-4 having a pressing device, driven roller 32-4 driven by the pressing roller 34-4, pressing belt 33-4 which is trained about these rollers, and heating drum roller 38-4 having a heating device which is to face the pressing belt 33-4. Heating drum roller 38-4 is comprised of a hollow metal roller and has heating element 38*a*-4 such as a halogen heater as a heat generating source in its interior parallel to its shaft. The drum roller 38-4 is heated utilizing heat generated by the heating element 38*a*-4, and recording medium 1 is pressed onto the drum roller 30-4 so that the curl is thermally corrected. Further, aforesaid pressing roller 34-4 is fitted with pressure application section 34*a*-4 comprised of springs, which presses the pressing roller 34-4 against aforesaid heating drum roller 38-4, and aforesaid heating drum roller 38-4 is pressed by the pressing roller utilizing a pressing force of the pressure section 34*a*-4. The curl of recording medium 1 is corrected utilizing pressure while the recording medium is interposed between these rollers. Further, aforesaid pressing belt 33-4 presses recording medium 1 onto aforesaid drum belt 38-4, employing tension or a pressure application means (not shown), and the curl of recording medium 1, which is transported between these, is corrected utilizing pressure.

As mentioned above, a curl correcting section is comprised of a belt and a drum roller and is structured to correct the curl of recording media, utilizing the curvature of the drum roller. It is then possible to simplify the curl correcting section, and in addition, to carry out a heating and pressing treatment over a sufficient period of time to correct the curl of the recording media. Accordingly, it is possible to cut production cost as well as to correct the curl for a flatter recording medium.

Incidentally, in curl correcting sections 3-1 through 3-4, heating temperature as well as applied pressure is to be controlled in the same manner as in aforesaid curl correcting section 3. Further, in the curl correcting sections 3-1 through 3-4, aforesaid guide 4 is to be arranged downstream in the recording medium transport direction. In addition, when aforesaid fixing section 12 is arranged in an ink jet recording apparatus provided with any of the curl correcting sections 3-1 through 3-4, it is possible to simultaneously carry out the correction process of the curl of recording media as well as the fixing process of the ink absorptive layer of the recording media in the fixing section 12, while combining any of the curl correcting sections 3-1 through 3-4 with the fixing section 12.

The ink jet recording medium preferably used in the present invention will now be detailed.

When images are printed on the ink jet recording medium, employing a water based ink, the resultant medium is subjected to curl due to swelling of water-soluble binders which absorb water or moisture from the air. Further, an ink jet recording medium provided in the form of a roll may occasionally be subjected to inherently formed curling.

The curl value in the present invention is determined by the following method.

<Curl Value>

A recording medium is cut to 20×20 cm and is set aside at an ambience of 23° C./50 percent relative humidity for two hours. Thereafter, the resultant medium is placed on a horizontal stand and the distance of each of the four corners from the surface of the stand is measured. Herein, the average of four measured values is designated as the curl value. A curl value, which is determined while the ink absorptive layer faces outward, is designated as a positive curl value. On the other hand, a curl value, which is determined while the ink absorptive layer faces inward, is designated as a negative curl value.

In order to evaluate curl characteristics of ink jet recording media, the processing as well as measurement, described below, is carried out.

<Method for Setting Initial Curl>

A recording medium is wound on the surface of a cylinder with a diameter of 6 cm so that the ink absorptive layer faces outward and is set aside in a room conditioned at 40 to 50° C. from several hours to half a day so that curl is inevitable. Setting-aside time is varied so that the resultant curl value ranges from −30 to −40 mm.

(Heating and Pressing Apparatus and Processing Method)

An apparatus is employed which is comprised of a ϕ30 mm circular iron cylinder (an upper roller) having a heater in its interior and a silicone rubber roller (a ϕ30 mm lower roller), both of which are covered with a tetrafluoroethylene-perfluoroalkyl ether copolymer. A recording medium is fed in so that the upper roller comes into contact with the surface of the ink absorptive layer, and is subjected to a simultaneous heating and processing treatment under conditions of a nip width of 0.3 mm and a linear pressure of 32 kgf/297 mm. During the treatment, the transport rate is 10 mm/second. Further, the surface temperature of the upper roller is adjusted to 120° C. Incidentally, the thickness of the cover layer comprised of tetrafluoroethylene-perfluoroalkyl ether copolymer is adjusted to 100 μm.

By employing the methods, it is possible to specify the ink jet recording medium of the present invention.

In the ink jet recording medium of the present invention, the weight ratio of the inorganic pigments to water-soluble binders is preferably from 3:1 to 9:1.

Listed as inorganic pigments, which are employed to achieve the aforesaid purpose, may be precipitated calcium carbonate, heavy calcium carbonate, magnesium carbonate, kaolin, clay, talc, calcium sulfate, barium sulfate, titanium dioxide, zinc oxide, zinc hydroxide, zinc sulfide, zinc carbonate, hydrotalcite, aluminum silicate, diatomaceous earth, calcium silicate, magnesium silicate, synthetic non-crystalline silica, colloidal silica, alumina, colloidal alumina, pseudo-boehmite, aluminum hydroxide, lithopone, zeolite, and magnesium hydroxide.

It is particularly preferable that employed as inorganic pigments are fine solid particles selected from silica, alumina, or alumina hydrates.

Preferably employed as silica, which can be employed in the present invention, is silica which is synthesized employing the conventional wet method, colloidal silica, or silica which is synthesized employing a gas phase method. Fine particle silica, which is most preferably employed, includes colloidal silica or fine particle silica which is synthesized employing a gas phase method. Of these, fine particle silica, which is synthesized employing a gas phase method, is preferred because it results in a high void ratio and in addition, coarse aggregates are barely formed when added to cationic polymers which is employed to fix the dyes. Further, alumina or alumina hydrate may be crystalline or non-crystalline. Still further, it is possible to employ optional shapes such as irregular-shaped particles, spherical particles, or needle-shaped particles.

Preferred inorganic pigments are in such a state that its fine particle dispersion, prior to mixing with cationic polymers, is dispersed into primary particles.

The particle diameter of the inorganic pigments is preferably at most 100 nm. For example, in the case of the aforesaid gas phase method fine particle silica, the average diameter of primary particles of inorganic pigments, which have been dispersed up to the primary particle, is preferably at most 100 nm, is more preferably from 4 to 50 nm, and is most preferably from 4 to 20 nm.

Gas phase method silica having an average diameter of primary particles of 4 to 20 nm, which is most preferably employed, include, for example, commercially available Aerosil, manufactured by Nippon Aerosil Co. It is relatively ease to disperse the gas phase method silica up to primary particles through suction dispersion into water, employing, for example, a jet stream inductor mixer, manufactured by Mitamura Riken Kogyo Co., Ltd.

Listed as water-soluble binders usable in the present invention are, for example, polyvinyl alcohol, gelatin, polyethylene oxide, polyvinylpyrrolidone, polyacrylic acid, polyacrylamide, polyurethane, dextran, dextrin, agar, Pullulan, water-soluble polyvinyl butyral, hydroxyethyl cellulose, and carboxymethyl cellulose. These water-soluble binders may be employed in combinations of at least two types.

The water-soluble binder, which is preferably employed in the present invention, is polyvinyl alcohol.

Other than common polyvinyl alcohol which is prepared by hydrolyzing polyvinyl acetate, polyvinyl alcohol includes modified polyvinyl alcohol such as polyvinyl alcohol of which terminals are subjected to cation modification and anion-modified polyvinyl alcohol having an anionic group.

The average degree of polymerization of polyvinyl alcohol which is prepared by hydrolyzing vinyl acetate is preferably at least 1,000, and is more preferably from 1,500 to 5,000. Further, the saponification ratio is preferably from 70 to 100 percent, and is more preferably 80 to 99.5 percent.

The cation modified polyvinyl alcohol includes polyvinyl alcohol having a primary, secondary, or tertiary amino group or a quaternary ammonium group in the main chain or side chain thereof, described in, for example, Japanese Patent Publication Open to Public Inspection No. 61-10483. It is possible to prepare the polyvinyl by saponifying a copolymer of ethylenic unsaturated monomers having a cationic group with vinyl acetate.

Listed as ethylenic unsaturated monomers having a cationic group are, for example, trimethyl-(2-acrylamido-2,2-dimethylethyl)ammonium chloride, trimethyl(3-acrylamido-3,3-dimethylprpyl)ammonium chloride, N-vinylimidazole, N-vinyl-2-methylimidazole, N-(3-dimethylaminopropyl)methacrylamide, hydroxyethyltrimethylammonium chloride, trimethyl(2-methacrylamidopropyl)ammonium chloride, and N-(1,1-dimethyl-3-dimethylaminopropyl)acrylamide.

The proportion of monomers having a cation modified group of polyvinyl alcohol is commonly from 0.1 to 10.0 mol percent with respect to vinyl acetate, and is preferably from 0.2 to 5.0 mol percent.

Listed as anion modified polyvinyl alcohols are, for example, polyvinyl alcohol having an anionic group as described in Japanese Patent Publication Open to Public Inspection No. 1-206088, copolymers of vinyl alcohol with vinyl compounds having a water solubilizing group as described in Japanese Patent Publication Open to Public Inspection Nos. 61-237681 and 63-307979, and modified polyvinyl alcohol having a water solubilizing group as described in Japanese Patent Publication Open to Public Inspection No. 7-285265.

Further, listed as nonion modified polyvinyl alcohol are listed, for example, polyvinyl alcohol derivatives which are prepared by partially adding a polyalkylene oxide group to polyvinyl alcohol, as described in Japanese Patent Publication Open to Public Inspection No. 7-9758, and block copolymers of vinyl compounds having a hydrophobic group with vinyl alcohol. At least two types of polyvinyl alcohol having different degrees of polymerization, or exhibiting different modification types, may be employed in combination.

Oil droplets comprised of hydrophobic organic compounds, having a melting point of less than or equal to 40° C., may be employed in the ink jet recording medium of the present invention. The water solubility of the hydrophobic organic compounds is commonly less than or equal to 0.1 percent by weight at room temperature, and is preferably less than or equal to 0.01 percent by weight. Further, the melting point of the same is at most 40° C. Listed as such hydrophobic organic compounds are organic compounds commonly known as hydrophobic high boiling point organic solvents and hydrophobic polymers having a melting point of less than or equal to 40° C.

Listed as hydrophobic organic compounds may be, for example, phthalic acid esters (dibutyl phthalate, dioctyl phthalate, and diisodecyl phthalate), phosphoric acid esters (tricresyl phosphate and trioctylphosphate), fatty acid esters (butyl stearate, bis(2-ethylhexyl)sebatate, ethylene glycol distearate, and glycerol tributylate), amides (N,N-diethyllaurylamide and N,N-diethyl-2-(2,5-di-t-amylphenoxy)butaneamide), ethers (ethylene glycol dibutyl ether, decyl ether, and dibenzyl ether), silicone oil, and liquid paraffin.

Emulsion resins according to the present invention, which have a Tg of less than or equal to 20° C. and are prepared employing polyvinyl alcohol as a dispersing agent, will now be described. Other than common polyvinyl alcohol which is prepared by hydrolyzing polyvinyl acetate, polyvinyl alcohol, employed as a dispersing agent includes modified polyvinyl alcohol such as cation modified polyvinyl alcohol, anion modified polyvinyl alcohol having an anionic group such as a carboxylic group, and silyl modified polyvinyl alcohol having a silyl group. The average degree of polymerization of the polyvinyl alcohol is preferably from 300 to 5,000, and the saponification ratio thereof is preferably from 70 to 100 mol percent.

Listed as resins which may be subjected to emulsion polymerization, employing polyvinyl alcohol, are homopolymers as well as copolymers of acrylic acid esters, methacrylic acid esters, vinyl based compounds, ethylene based monomers such as styrene based compounds, and diene based compounds such as isoprene. For example, listed are acryl based resins, styrene-butadine based resins, and ethylene-vinyl acetate based resins.

These emulsion resins provide flexibility in a void layer during its formation. Resins, which are flexible at room temperature, are preferred. The more preferred resins are those which form the layer upon being fused at room temperature. At such time, the Tg of the film formed by the emulsion resins is preferably less than or equal to 20° C., and is more preferably from −40 to 10° C.

Listed as thermoplastic resins according to the present invention are, for example, polycarbonates, polyacrylonitriles, polystyrenes, polyacrylic acids, polymethacrylic acids, polyvinyl chloride, polyvinylidene chloride, polyvinyl acetate, polyesters, polyamides, polyethers, copolymers thereof, and salts thereof. Of these, preferred are styrene-acrylic acid ester copolymers, vinyl chloride-vinyl acetate copolymers, vinyl chloride-acrylic acid ester copolymers, ethylene-vinyl acetate copolymers, ethylene-acrylic acid ester copolymers, and SBR latex.

Further, the thermoplastic resins may be employed by mixing a plurality of copolymers which differ in the monomer composition, the particle diameter, and the degree of polymerization.

The thermoplastic resins should be selected while taking into account ink absorbability, glossiness of images after fixing carried out by heating and pressing, image durability, and releasability.

With regard to the ink absorbability, when the diameter of thermoplastic resin particles is less than 0.05 $\mu$m, the rate of ink absorption decreases due to slow separation of pigment particles in the pigment ink from ink solvents. Further, exceeding 10 $\mu$m of the diameter is not preferred from the viewpoint of the degradation of the layer strength as well as of the glossiness of ink jet recording media after coating and drying. As a result, the diameter of thermoplastic resin particles is preferably from 0.05 to 10.00 $\mu$m, is more preferably from 0.1 to 5.0 $\mu$m, and is still more preferably from 0.1 to 1.0 $\mu$m.

Listed as a standard for selecting the thermoplastic resins is the glass transition point (Tg). When the Tg is lower than coating drying temperature, for example, voids disappear due to the presence of the thermoplastic resins, since the coating drying temperature during the production of a recording medium has been higher than the Tg so that ink solvents pass through. Further, when the Tg is higher than the temperature which results in modification due to heat, in order to carry out fusing and layer formation after ink jet recording employing a pigment ink, fixing at high temperature is required. As a result, there occur problems when a load is applied to the apparatus, as well as thermal stability. The Tg of the thermoplastic resins is preferably from 50 to 150° C.

Further, thermoplastic resins having a minimum filming temperature (MFT) of 50 to 150° C. are preferred.

From an ecological viewpoint, those thermoplastic resins are preferred which are dispersed in water based media, and specifically preferred are water based latexes which are prepared by emulsion polymerization. Of these, it is possible to preferably employ types which are prepared by emulsion polymerization, employing nonionic dispersing agents as an emulsifying agent. In addition, from the viewpoint of eliminating unpleasant odors as well as optimal safety, the less of the monomer components which remain, the more preferable. The proportion of remaining monomer components is preferably less than or equal to 3 percent by weight with respect to solids of the polymer, is more preferably less than or equal to 1 percent by weight, and is still more preferably less than or equal to 0.1 percent by weight.

The weight of solids of thermoplastic resins incorporated in the surface layer is preferably in the range of 2 to 20 g/m$^2$, is more preferably in the range of 2 to 15 g/m$^2$, and is still more preferably in the range of 2.5 to 10.0 g/m$^2$. When the weight of solids of thermoplastic resins is excessively low, it is impossible to sufficiently disperse pigments into a layer due to the insufficient formation of the layer. Due to that, the resultant image quality as well as the resultant glossiness is not desirably enhanced. On the other hand, when the weight of solids of the thermoplastic resins is excessively high, it is impossible to form a layer of the thermoplastic resins during a short heating process. As a result, the image quality is degraded due to opacity caused by the presence of residual fine particles. Further problems occur in which bleeding occurs in the boundary due to a decrease in the rate of ink absorption.

The surface layer comprising the thermoplastic resin, as described in the present invention, is not particularly limited to the uppermost layer. The uppermost layer other than the surface layer may be provided on the surface layer for protecting the surface or for other purposes. In the ink jet recording medium of the present invention, it is preferable that, after image recording, thermoplastic resins, which are incorporated in the surface layer, are fused so as to form a layer by, for example, heating. For example, in the case of printing employing a dye ink, when lightfastness or water-fastness can be enhanced by the heating process after image recording. Further, in the case of printing employing a pigment ink, image qualities such as glossiness and abrasion resistance or the degree of bronzing can be improved by the heating process after image recording.

Hardening agents, which may be employed in the present invention, are not particularly limited, as long as they undergo hardening reaction with water-soluble binders, but are preferably boric acids and salts thereof. Other than these, it is generally possible to employ compounds having a group capable of reacting with water-soluble binders or compounds which promote the reaction between different groups of water-soluble binders. They are appropriately selected depending on the types of water-soluble binders and then employed.

Listed as specific examples of the hardening agents are epoxy based hardening agents (diglycidyl ethyl ether, ethylene glycol diglycidyl ether, 1,4-butanedioldiglycidyl ether, 1,6-diglycidylcyclohexane, N,N-diglycidyl-4-glycidyloxyaniline, sorbitol polyglycidyl ether, and glycerol polyglycidyl ether); aldehyde based hardening agents (formaldehyde and glyoxal); active halogen based hardening agents (2,4-dichloro-6-hydroxy-1,3,5-s-triazine); active vinyl based compounds (1,3,5-trisacryloyl-6H-s-triazine and bisvinyl sulfonylmethyl ether); and aluminum alum.

Boric acids or salts thereof, as described herein, refer to oxygen acids having a boron atom as a central atom, and salts thereof. Specific examples include orthoboric acid, diboric acid, metaboric acid, tetraboric acid, pentaboric acid, and octaboric acid, and salts thereof. Boric acids having a boron atom and salts thereof, as a hardening agent, may be employed individually in the form of an aqueous solution or may be employed in combination. Most preferably employed are aqueous solutions containing a mixture of boric acids and borax. Due to low water solubility of both boric acids and borax, it is only possible to add each of them employing a relatively low concentration solution. However, when boric acids and borax are employed in combination, it is possible to prepare a relatively high concentration aqueous solution. As a result, it is possible to concentrate the coating composition. Further, the mixing results in advantages in which it is possible to relatively optionally control the pH of the added aqueous solution.

For the purpose of minimizing image bleeding during storage after recording, cationic polymers are preferably employed in the ink jet recording medium of the present invention.

Listed as examples of cationic polymers are polyethyleneimine, polyallylamine, polyvinylamine, dicyandiamidopolyalkylenepolyamine condensation products, polyalkylenepolyaminedicyandiamide ammonium salt condensation products, dicyandiamidoformalin condensatin products, epichlorhydrin-dialkylamine addition polymers, diallyldimethylammonium chloride polymers, diallyldimethylammonium chloride-$SO_2$ copolymers, polyvinylimidazole, vinylpyrrolidone-vinylimidazole copolymers, polyvinyl pyridine, polyamidine, chitosan, cationized starch, vinylbenzyltrimethylammonium chloride polymers, (2-methachloyloxyethyl)trimethylammonium chloride polymers, and dimethylaminoethyl methacrylate polymers.

Appropriately selected as supports according to the present invention are supports conventionally employed in ink jet recording media, such as paper supports including plain paper, art paper, coated paper, and cast-coated paper, plastic supports, paper supports coated with polyethylene on both sides, composite supports laminated with the above supports, and may then be employed.

For the purpose of enhancing the adhesion strength between the support and the ink absorptive layer, the ink jet recording medium of the present invention is preferably subjected to a corona discharge treatment and a subbing treatment prior to coating the ink absorptive layer. Further, the recording medium of the present invention need not always be white, but it may also be a colored recording sheet.

It is most preferable to employ paper supports laminated with polyethylene on both sides so that recorded images are analogous to conventional photographic images and high quality images can be prepared at low cost. Such paper supports, which are laminated with polyethylene, will now be described.

Base paper employed for the paper support is produced employing wood pulp as a main raw material, and if desired, employing synthetic pulp such as polypropylene, or synthetic fiber such as nylon or polyester. As wood pulp, for example, any of LBKP, LBSP, NBKP, NBSP, LDP, NDP, LUKP, and NUKP may be employed. However, LBKP, NBSP, LBSP, NDP, and LDP having shorter fibers are preferably employed in a larger proportion. However, the content proportion of LBSP or LDP is preferably from 10 to 70 percent by weight.

As the aforesaid pulp, chemical pulp (sulfate salt pulp and sulfite pulp) containing minimum impurities is preferably employed, and pulp, which has been subjected to a bleaching treatment to increase whiteness, is also beneficial. Suitably incorporated in the base paper may be, for example, sizing agents such as higher fatty acids and alkylketene dimers, white pigments such as calcium carbonate, talc, titanium dioxide, paper strength enhancing agents such as starch, polyacrylamide, and polyvinyl alcohol, optical brightening agents, moisture retaining agents such as polyethylene glycols, dispersing agents, and softeners such as quaternary ammonium salts.

If desired, various types of additives may be incorporated in optional layers on the side of the ink absorptive layer of the ink jet recording paper sheets of the present invention.

The following additives known in the art may be incorporated: for example, UV absorbers described in Japanese Patent Publication Open to Public Inspection Nos. 57-74193, 57-87988, and 62-261476; anti-discoloring agents described in Japanese Patent Publication Open to Public Inspection Nos. 57-74192, 57-87989, 60-72785, 61-146591, 1-95091, and 3-13376; various types of anion, cation, and nonion surface active agents; optical brightening agents described in Japanese Patent Publication Open to Public Inspection Nos. 59-42993, 59-52689, 62-280069, 61-242871, and 4-219266; pH regulators such as sulfuric acid, phosphoric acid, acetic acid, citric acid, sodium hydroxide, potassium hydroxide, and potassium carbonate; antifoaming agent; lubricating agents such as diethylene glycol; antiseptic agents; thickeners; antistatic agents; and matting agents.

In the present invention, when a roll recording medium is employed, more desired effects are exhibited. The roll recording medium, as described herein, refers to one which is prepared by winding a long recording medium onto a core. The diameter (the outer diameter) of the core is not particularly limited, but is preferably less than or equal to 10 cm so that the total dimensions of the printing apparatus do not become excessively large. The diameter is more preferably from 2 to 10 cm. The width of the roll is not particularly limited, but the desired range is from 5 to 120 cm. In addition, the length of the roll recording medium is not particularly limited, but the desired range is from 5 to 200 m.

The production method of the ink jet recording medium of the present invention will now be described.

The ink jet recording medium is produced employing a method in which constitution layers comprising an ink absorptive layer are individually or simultaneously applied onto a support, employing a method which is appropriately selected from methods known in the art, and subsequently dried. Preferably employed coating methods include, for example, a roll coating method, a rod bar coating method, an air knife coating method, a spray coating method, a curtain coating method, a slide bead coating method employing a hopper, described in U.S. Pat. Nos. 2,761,419 and 2,761,791, or an extrusion coating method.

When simultaneous multilayer coating is carried out, the viscosity of the coating composition employed for the slide bead coating method is preferably in the range of 5 to 100 mPa·s, and is more preferably in the range of 10 to 50 mPa·s. The viscosity of the coating composition employed for the curtain coating method is preferably in the range of 5 to 1,200 mPa·s, and is more preferably in the range of 25 to 500 mpa·s.

Further, the viscosity of the coating composition at 15° C. is preferably at least 100 mPa·s, is more preferably from 100 to 30,000 mPa·s, still more preferably from 3,000 to 30,000 mpa·s, and is most preferably from 10,000 to 30,000 mPa·s.

The coating and drying method is as follows. Coating compositions are heated to 30° C. and are then subjected to simultaneous multilayer coating. Thereafter, it is preferable that the resultant coating be temporarily cooled to 1 to 15° C. and subsequently dried at more than or equal to 10° C. It is preferable that the coating compositions be prepared, coated, and dried at a temperature lower than or equal to the Tg of the thermoplastic resins so that the thermoplastic resins incorporated in the surface layer are not subjected to filming during the preparation of the coating compositions, as well as during coating and drying. Drying is more preferably carried out under conditions in which the wet bulb temperature is in the range of 5 to 50° C., and the coating surface temperature is in the range of 10 to 50° C. Further, from the viewpoint of achieving uniform coating, it is preferable to use a horizontal setting system as a cooling system immediately after coating.

Further, it is preferable that the production process includes a step which stores the resultant coating at 35 to 70° C. from 24 hours to 60 days.

Heating conditions are not particularly limited as long as conditions are satisfied in which the resultant coating is stored at 35 to 70° C. from 24 hours to 60 days. Preferred examples include 3 days to 4 weeks at 36° C., 2 days to 2 weeks at 40° C., and 1 to 7 days at 55° C. The heating process is capable of enhancing the hardening reaction of water-soluble binders or the crystallization of water-soluble binders. As a result, it is possible to achieve desired ink absorbability.

When images are recorded employing the ink jet recording medium of the present invention, a recording method employing water based ink is preferably employed. Employed as the water based ink may be water based dye ink or water based pigment ink. The water based dye ink or water based pigment ink, as described herein, refers to a recording composition comprising the colorants described below, liquid media, and other additives.

Employed as colorants may be direct dyes, acid dyes, basic dyes, and reactive dyes known in the art for ink jet printing, water-soluble dyes such as food dyes, or water based pigments such as organic pigments such as azo pigments, phthalocyanine pigments, and dye lakes, as well as inorganic pigments such as carbon black.

Listed as other additives for the water based ink may be, for example, water-soluble organic solvents (propanol, hexanol, ethylene glycol, diethylene glycol, glycerin, hexanediol, or urea), surface active agents, water-soluble polymers, antiseptic agents, antifungal agents, viscosity modifiers, and pH regulators.

EXAMPLES

The present invention is specifically described with reference to examples. However, the present invention is not limited to these examples. Incidentally the trem "percent" described in the examples is percent by weight unless otherwise specified.

<<Preparation of Silica Dispersion 1>>

Suction-dispersed 125 kg of gas phase method silica (QS-20, manufactured by Tokuyama Co., Ltd.) having an average diameter of primary particles of 0.012 μm was into 620 L of pure water of which pH was adjusted to 2.5 by adding nitric acid, employing Jet Stream Inductor Mixer TDS, manufactured by Mitamura Riken Kogyo Co., Ltd. Subsequently, the total volume of the resultant dispersion was adjusted to 694 L by adding pure water, whereby Silica Dispersion 1 was prepared.

While stirring, 69.4 L of the aforesaid Silica Dispersion 1 was added to an aqueous solution (having a pH of 2.3) comprising 1.14 kg of cationic polymer (P-1), 2.2 L of ethanol, and 1.5 L of n-propanol, and subsequently, 7.0 L of an aqueous solution containing 260 g of boric acid and 230 g of borax was added to the resultant mixture. Further, added was one g of antifoaming agent SN381 (manufactured by Sun Nopco Limited). The resultant mixture was dispersed, employing a high pressure homogenizer, manufactured by Sanwa Kogyo Co., Ltd. The volume of the resultant dispersion was adjusted by adding pure water, whereby Silica Dispersion 2 was prepared.

<<Preparation of an Oil Droplet Composition>>

While heating, 20 g of diisodecyl phthalate (having an mp of −53° C.) and 20 g of an antioxidant (AO-1) were dissolved in 45 g of ethyl acetate. The resultant mixture was combined with 210 ml of a gelatin solution containing 8 g of acid process gelatin, 2.9 of a cationic polymer (P-1), and 10.5 g of saponin (manufactured by Eastman Chemical Co.) at 55° C., and the resultant mixture was dispersed employing a high pressure homogenizer. Thereafter, the total volume of the resultant dispersion was adjusted to 300 ml by adding pure water, whereby an oil droplet composition was prepared.

Cationic polymer P-1

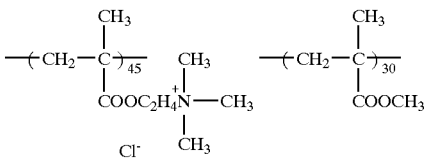

-continued

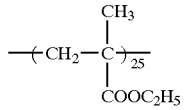

Antioxidant (AO-1)

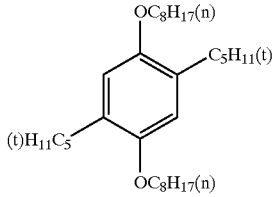

<<Synthesis of an Emulsion Resin>>

The pH of 5 percent aqueous polyvinyl alcohol solution (polyvinyl alcohol having a degree of polymerization of 1,700, and a saponification ratio of 88.5 percent) was adjusted to 3.5 pH. Subsequently, while stirring, 50 g of methyl methacrylate and 50 g of butyl acrylate were added. Subsequently, the resultant mixture was heated to 60° C. and then polymerization was initiated upon adding 10 g of a 5 percent ammonium persulfate. After 15 minutes, 100 g of butyl methacrylate and 100 g of butyl acrylate were slowly added over three hours. After 5 hours, when the polymerization ratio reached 99.9 percent, the resultant reaction product was cooled. The pH of the resultant product was neutralized to 7.0, whereby an emulsion resin was synthesized.

Incidentally, the emulsion resin was dried at 60° C., employing a vacuum dryer and the Tg was determined, employing a differential scanning calorimeter, resulting in 5° C.

<<Preparation of Coating Composition 1>>

Coating Composition 1 was prepared employing Silica Dispersion 2 prepared as above.

While stirring at 40° C., 130 ml of a 10 percent aqueous solution of polyvinyl alcohol (PVA235, manufactured by Kuraray Kogyo Co., Ltd.) was added to 600 ml of Silica Dispersion 2. Subsequently, the total volume was adjusted to 1,000 ml by adding pure water. The resultant dispersion was designated as Coating Composition 1.

<<Preparation of Coating Compositions 2 through 4>>

Each of Coating Compositions 2 through 4 was prepared in the same manner as Coating Composition 1, except that 130 ml of 10 percent polyvinyl alcohol which had been added to Coating Composition 1 was replaced with each of 110 ml, 95 ml, or 195 ml, respectively.

<<Preparation of Coating Composition 5>>

Coating Composition 5 was prepared in the same manner as Coating Composition 2, except that 30 ml of an oil droplet composition prepared as above was added to the Coating Composition 2.

<<Preparation of Coating Composition 6>>

While stirring at 40° C., 100 ml of 10 percent aqueous solution of polyvinyl alcohol (PVA235, manufactured by Kuraray Kogyo Co., Ltd.), was added to 600 ml of the aforesaid silica dispersion, and further 6.0 g of the aforesaid synthesized emulsion resin was added. The total volume of the resultant mixture was adjusted to 1,000 ml by adding pure water. The resultant mixture was designated as Coating Composition 6.

<<Preparation of Mixed Silica and Thermoplastic Resin Coating Composition 1>>

While stirring at 40° C., 600 ml of the aforesaid Coating Composition was added with, as a thermoplastic resin, a styrene-acryl based latex polymer (having a Tg of 78° C., an average particle diameter of 0.2 μm, and a solid concentration of 50 percent), which had been prepared by emulsion polymerization, employing an aqueous polyvinyl alcohol solution as a emulsifying agent, of which pH was adjusted to 4.7 employing a 6 percent aqueous nitric acid solution while the weight ratio of silica to the thermoplastic resin was adjusted to achieve 1:1. The total volume of the resultant mixture was adjusted to 1,000 ml by adding pure water, whereby Mixed Silica and Thermoplastic Resin Coating Composition 1 was prepared.

<<Preparation of Mixed Silica and Thermoplastic Resin Coating Composition 2>>

Mixed Silica and Thermoplastic Resin Coating Composition 2 was prepared in the same manner as Mixed Silica and Thermoplastic Resin Coating Composition 1, except that Coating Composition 1 was replaced with Coating Composition 5.

(Preparation of Ink Jet Recording Medium 1)

Coating Composition 1, prepared as above, was applied onto the surface of the polyethylene coated support constituted as described below so as to obtain a wet coating thickness of 200 μm. A base paper having a base weight of 170 g/m$^2$ was coated with polyethylene on both sides. The polyethylene layer on the ink absorptive layer side, comprised anatase type titanium oxide in an amount of 8 percent by weight and a gelatin subbing layer in a coating weight of 0.05 g/m$^2$, was provided on the ink absorptive layer side. On the opposite side, a backing layer at a coating weight of 0.2 g/m$^2$ was provided which was comprised of a latex polymer having a Tg of approximately 80° C. After temporarily cooling the resulting coating to approximately 7° C., the coating was dried by 20 to 65° C. forced air, whereby Ink Jet Recording Medium 1 of the present invention was prepared.

(Preparation of Ink Jet Recording Media 2 through 6)

Each of Ink Jet Recording Media 2 through 6 was prepared in the same manner as Ink Jet Recording Medium 1, except that Coating Composition 1 was replaced with each of Coating Compositions 2 through 6.

(Preparation of Ink Jet Recording Medium 7)

Mixed Silica and Thermoplastic Resin Coating Composition 1 prepared as above was applied onto Ink Jet Recording Medium 1 so as to obtain a wet coating thickness of 50 μm. After temporarily cooling the resultant coating to approximately 7° C., the coating was dried by 20 to 65° C. forced air, whereby Ink Jet Recording Medium 7 of the present invention was prepared.

(Preparation of Ink Jet Recording Medium 8)

Ink Jet Recording Medium 8 of the present invention was prepared in the same manner as Ink Jet Recording Medium 7, except that Mixed Silica and Thermoplastic Resin Coating Composition 2 was applied onto Ink Jet Recording Medium 2.

(Preparation of Ink Jet Recording Medium 9)

Ink Jet Recording Medium 9 of the present invention was prepared in the same manner as Ink Jet Recording Medium 7, except that Mixed Silica and Thermal Plastic Resin Coating Composition 1, prepared as above, was applied onto Ink Jet Recording Medium 3.

(Preparation of Ink Jet Recording Medium 10)

Ink Jet Recording Medium 10 of the present invention was prepared in the same manner as Ink Jet Recording Medium 7, except that Mixed Silica and Thermal Plastic Resin Coating Composition 1, prepared as above, was applied onto Ink Jet Recording Medium 6.

(Preparation of Ink Jet Recording Medium 11)

Ink Jet Recording Medium 11 of the present invention was prepared in the same manner as Ink Jet Recording Medium 7, except that Mixed Silica and Thermal Plastic Resin Coating Composition 2, prepared as above, was applied onto Ink Jet Recording Medium 6.

(Preparation of Ink Jet Recording Medium 12)

Dispersion 3 was prepared in the same manner as the preparing method of Silica Dispersion 2 except that the Silica Dispersion 1 was not added. Subsequently, Coating Composition 7 was prepared in the same manner as the preparation method of Coating Composition 1 except that the Dispersion 3 was used instead of Silica Dispersion 2. Ink Jet recording medium 12 was prepared in the same manner as the Ink Jet Recording Medium 1, except for the Coating Composition 7 was used instead of Coating Composition 1.

<<Curl Measurement>>

<Initial Curl Providing and Measurement>

A recording medium was cut into 20×20 cm, and the resultant cut samples were wound onto the exterior surface of a cylindrical body having a diameter of 6 cm so that the ink absorptive layer of the recording medium faced outside. The wound sample was set aside in a room, regulated at 40 to 50° C., from about several hours to about half a day. The setting-aside period was adjusted so that the resultant curl value reached 30 to 40 mm. Thereafter, the sample was removed from the cylindrical body and was then set aside in an ambience of 23° C. and 50 percent relative humidity for two hours. Subsequently, the resultant sample was placed on a horizontal plane and the average distance of four corners departing from the plane was determined.

<Curl Measurement after Heating and Pressing>

Each sample, which had resulted in the initial curl values shown in Table 1, was subjected to a treatment (120° C. and a linear pressure of 32 kgf/297 mm) employing the aforesaid heating pressing apparatus. Thereafter, the curl value of each sample was determined in the same manner as above.

Table 1 shows the measurement results.

TABLE 1

| Ink Jet Recording medium | Ink Absorptive Layer: Coating Composition | Silica: Water Based Binder | Synthetic Emulsion | Oil Droplet | Surface layer Inorganic pigment-thermo-plastic resin | Curl after: Initial Curl (mm) | Heating and Pressing (mm) | Remarks |
|---|---|---|---|---|---|---|---|---|
| 1 | 1 | 6:1 | — | — | — | −35 | −8 | Inventive |
| 2 | 2 | 7:1 | — | — | — | −32 | −7 | Inventive |
| 3 | 3 | 8:1 | — | — | — | −34 | −8 | Inventive |
| 4 | 4 | 4:1 | — | — | — | −36 | −10 | Inventive |
| 5 | 5 | 7:1 | — | Added | — | −32 | −8 | Inventive |
| 6 | 6 | 6:1 | Added | — | — | −31 | −7 | Inventive |
| 7 | 1 | 6:1 | — | — | 6:1 | −34 | −3 | Inventive |
| 8 | 2 | 6:1 | — | — | 7:1 | −37 | −4 | Inventive |
| 9 | 3 | 6:1 | Added | — | 6:1 | −36 | −1 | Inventive |
| 10 | 6 | 6:1 | Added | — | 6:1 | −32 | +1 | Inventive |
| 11 | 6 | 6:1 | Added | — | 7:1 | −33 | 0 | Inventive |
| 12 | 7 | No Silica | — | — | — | −36 | −20 | Comparative |

<<Evaluations>>

<Variance of Environmental Curl>

Each of the above-prepared Recording Materials was cut into 20×20 cm, and the resultant cut samples were left at 10° C., 20% RH, for from several hours to half a day. Thereafter, the resultant sample was placed on a horizontal plane and the average distance of four corners departing from the plane was determined. The average distance is referred to as A (mm). The curl of upper direction from the surface of the Recording material is represented by +, and that of opposite direction is represented by −. Concurrently, each of the Cut Samples was left at 30° C., 80% RH in the same manner as above. The average distance of four corners departing from the plane was referred to as B (mm). The Variance of Environmental Curl of Each of the Cut Samples was determined by A−B.

<Crack Generation on the Surface>

Each of the Recording mediums, prepared above was installed in a large format ink jet printer IGUAZU 1440 (manufactured by Konica Corp.) and color images were prepared. The resultant image was subjected to treatment at a temperature of 120° C. and a linear pressure of 32 kgf/297 mm, employing the heating and pressing apparatus described above. Thereafter, each of the Resultant Samples was stored under 40° C., 80% RH for 1 month and The Crack generation on the Surface was observed. The conditions were classified into following 4 classes.

A: No crack was observed.

B: The number of cracks is less than 5 in 20×20 cm.

C: The number of cracks is not less than 5 and less than 10 in 20×20 cm.

D: The number of cracks is not less than 10 in 20×20 cm.

The evaluated results are shown in following Table 2.

TABLE 2

| Ink Jet Recording Material | Difference of Environmental Curl | Crack Generation on the surface | Remarks |
|---|---|---|---|
| 1 | +15 | B | Inventive |
| 2 | +8 | B | Inventive |
| 3 | +10 | B | Inventive |
| 4 | +16 | C | Inventive |
| 5 | +14 | B | Inventive |

TABLE 2-continued

| Ink Jet Recording Material | Difference of Environmental Curl | Crack Generation on the surface | Remarks |
|---|---|---|---|
| 6 | +13 | B | Inventive |
| 7 | −3 | A | Inventive |
| 8 | +5 | A | Inventive |
| 9 | −3 | A | Inventive |
| 10 | +2 | A | Inventive |
| 11 | −4 | A | Inventive |
| 12 | +30 | D | Comparative |

When the environmental condition, primarily the humidity and the temperature, vary, curls of ink jet recording materials tend to varies doe to swelling of the binder or other components in the recording material or variation of degree of contraction. However, the ink jet recording material of the present invention showed relatively low variances of curl. Further, during storage, especially under high humidity and high temperature, the ink absorptive layer in the recording material swells by absorbing water. On the other hand, the surface of the recording material dries and forms a film. Thus, due to the distortion between the inside and outside of the recording material, cracks tend to generate. However, the ink jet recording materials of the present invention generated relatively few cracks.

Example 2

A sample of Ink Jet Recording Medium 7, prepared in Example 1 having a width of 297 mm and a length of 20 m after coating, was wound onto a core having a diameter of 7.6 cm so that the ink absorptive layer faced outside. The resultant roll was installed in a large format ink jet printer IGUAZU 1440 (manufactured by Konica Corp.) and color images were prepared. The resultant image was subjected to treatment at a temperature of 120° C. and a linear pressure of 32 kgf/297 mm, employing the heating and pressing apparatus employed in Example 1. Ink jet prints, which did not exhibit curl, were obtained.

Effects of the Invention

As mentioned above, by employing the ink jet recording apparatus according to the present invention, it is possible to correct the curl of the recording medium to be flat, prior to carrying out recording employing a printing head by suitably carrying out a heating and pressing treatment based on the characteristics of the recording medium, the magnitude of curl, and the residual quantity of the bulk roll. As a result, it is possible to prepare high image quality prints, resulting in no contact of the printing head with the recording medium, and it is also possible to prepare image prints exhibiting no curl.

According to the present invention, it is possible to provide an ink jet recording medium which exhibits excellent flatness and an image forming method using the same.

What is claimed is:

1. An ink jet recording method comprising the steps of:

forming an image on a recording medium comprising a support having thereon an ink absorptive layer comprising an inorganic pigment and a water soluble binder by jetting an ink onto the recording medium; and correcting a curl of the recording medium by applying heat and pressure to the recording medium, wherein the recording medium shows a curl value of between −10 and 10 mm after applying a heat and pressure treatment in the following condition to the recording medium having a curl value between −30 of −40 mm, wherein the condition of the heat and pressure treatment is:

employing an apparatus comprising a ϕ30 mm circular iron cylinder having a heater in its interior as an upper roller and a ϕ30 mm silicone rubber roller as a lower roller, both of which are covered with a tetrafluoroethylene-perfluoroalkyl ether copolymer having a thickness of 100 μm;

feeding the recording medium in so that the upper roller comes into contact with the surface of the ink absorptive layer; and subjecting the recording medium to the heat and pressure treatment under conditions of a nip width of 0.3 mm, a linear pressure of 32 kgf/297 mm, transporting rate of 10 mm/second and the surface temperature of the upper roller of 120° C.

2. The ink jet recording method of claim 1, wherein the weight ratio of the inorganic pigment to the water soluble binder in the ink absorptive layer of the recording medium is from 3:1 to 9:1.

3. The ink jet recording method of claim 1, wherein the ink absorptive layer of the recording medium comprises an emulsion resin having a glass transition point Tg of not more than 20° C., and the emulsion resin is obtained with utilizing polyvinyl alcohol as a dispersing medium.

4. The ink jet recording method of claim 1, wherein the recording medium further comprising a surface layer comprising a thermoplastic resin on the ink absorptive layer.

5. The ink jet recording method of claim 4, wherein the surface layer further comprises a inorganic pigment.

6. The ink jet recording method of claim 4, wherein the heat applied to the recording medium in the correcting step is lower than the melt temperature of the thermoplastic resin.

7. The ink jet recording method of claim 1, wherein the center line mean roughness specified in JIS B 0601 of the ink absorptive layer is 0.8 to 4.0 when the ink absorptive layer is measured at a standard length of 2.5 mm and a cut-off value of 0.8 mm.

8. The ink jet recording method of claim 1, wherein the ink is a pigment ink.

9. An ink jet recording medium comprising a support having thereon an ink absorptive layer comprising an inorganic pigment and a water soluble binder and a surface layer comprising a thermoplastic resins, wherein the recording medium shows a curl value of between −10 and 10 mm after applying a heat and pressure treatment of the following condition to the recording medium having a curl value between −30 to −40 mm, wherein the condition of the heat and pressure treatment is:

employing an apparatus comprising a ϕ30 mm circular iron cylinder having a heater in its interior as an upper roller and a ϕ30 mm silicone rubber roller as a lower roller, both of which are covered with a tetrafluoroethylene-perfluoroalkyl ether copolymer having a thickness of 100 μm;

feeding the recording medium in so that the upper roller come into contact with the surface of the ink absorptive layer; and subjecting the recording medium to the heat and pressure treatment under conditions of a nip width of 0.3 mm, a linear pressure of 32 kgf/297 mm, transporting rate of 10 mm/second and the surface temperature of the upper roller of 120° C.

10. The ink jet recording medium of claim 9, wherein the surface layer further comprises an inorganic pigment.

* * * * *